US012760928B2

(12) United States Patent
Sugai

(10) Patent No.: US 12,760,928 B2
(45) Date of Patent: Oct. 13, 2026

(54) INDOOR UNIT AND AIR CONDITIONER

(71) Applicant: Mitsubishi Electric Corporation, Tokyo (JP)

(72) Inventor: Shota Sugai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 394 days.

(21) Appl. No.: 18/571,596

(22) PCT Filed: Oct. 19, 2021

(86) PCT No.: PCT/JP2021/038516
§ 371 (c)(1),
(2) Date: Dec. 18, 2023

(87) PCT Pub. No.: WO2023/067672
PCT Pub. Date: Apr. 27, 2023

(65) Prior Publication Data
US 2024/0280291 A1 Aug. 22, 2024

(51) Int. Cl.
*F24F 13/28* (2006.01)
*F24F 1/0057* (2019.01)

(52) U.S. Cl.
CPC ..... *F24F 13/28* (2013.01); *F24F 1/0057* (2019.02)

(58) Field of Classification Search
CPC ..... F24F 1/0057; F24F 1/0073; F24F 13/28
USPC ..... 454/236
See application file for complete search history.

(56) References Cited

U.S. PATENT DOCUMENTS 5,092,396 A * 3/1992 Murano ..... F24F 1/0073 403/345
2006/0021359 A1* 2/2006 Hur ..... F24F 1/0073 62/126
2006/0032260 A1* 2/2006 Kang ..... F24F 1/0067 62/298
2006/0201184 A1* 9/2006 Ito ..... F24F 1/0073 29/890.035

(Continued)

FOREIGN PATENT DOCUMENTS

CN 204629968 U 9/2015
CN 105157114 A 12/2015

(Continued)

OTHER PUBLICATIONS

International Search Report of the International Searching Authority mailed Dec. 28, 2021 in corresponding International Application No. PCT/JP2021/038516 (and English translation).

(Continued)

*Primary Examiner* — Vivek K Shirsat
(74) *Attorney, Agent, or Firm* — Posz Law Group, PLC

(57) ABSTRACT

An indoor unit according to an embodiment of the present disclosure, which is the indoor unit of an air conditioner, and is the indoor unit that is a wall-mounted type which is mounted on a wall that includes: a heat exchange device; a blower; a housing that has an intake port, and that houses the heat exchange device and the blower therein, and a filter that is disposed between the intake port and the heat exchange device, wherein the housing has an insertion port through which the filter is inserted, the insertion port opens to a front, and the filter is attached to the housing so as to be detachable from an outside of the housing via the insertion port.

8 Claims, 12 Drawing Sheets

(56) References Cited

U.S. PATENT DOCUMENTS

| | | | | |
|---|---|---|---|---|
| 2009/0158765 | A1* | 6/2009 | Ooishi | F24F 13/20 62/263 |
| 2015/0211782 | A1* | 7/2015 | Ikeda | F24F 1/0073 62/291 |
| 2017/0198936 | A1* | 7/2017 | Yamaguchi | F24F 11/74 |
| 2017/0370605 | A1* | 12/2017 | Makino | F24F 11/36 |
| 2018/0023820 | A1* | 1/2018 | Kim | F24F 13/30 250/435 |
| 2020/0018493 | A1* | 1/2020 | Shirota | F24F 1/0011 |
| 2021/0063026 | A1* | 3/2021 | Kim | F24F 13/28 |
| 2021/0354958 | A1* | 11/2021 | Mandy | B66B 11/024 |

FOREIGN PATENT DOCUMENTS

| | | | |
|---|---|---|---|
| CN | 212057519 | U | 12/2020 |
| JP | S60-121127 | U | 8/1985 |
| JP | H04-132322 | U | 12/1992 |
| JP | H09-206534 | A | 8/1997 |
| JP | 2001-324211 | A | 11/2001 |
| JP | 2004-125206 | A | 4/2004 |
| JP | 2004-347255 | A | 12/2004 |
| JP | 2011-058719 | A | 3/2011 |
| JP | 2016-205675 | A | 12/2016 |
| KR | 10-1999-0024328 | A | 4/1999 |
| KR | 10-2018-0008065 | A | 1/2018 |

OTHER PUBLICATIONS

Office Action dated Apr. 2, 2025 issued in corresponding German Patent Application No. 112021008375.9 (and English machine translation).

Office Action dated Jan. 29, 2026 issued in corresponding Turkish Patent Application No. 2024/001503 (and English machine translation).

* cited by examiner

INDOOR UNIT AND AIR CONDITIONER

CROSS REFERENCE TO RELATED APPLICATION

This application is a U.S. national stage application of International Application No. PCT/JP2021/038516, filed on Oct. 19, 2021, the contents of which are incorporated herein by reference.

TECHNICAL FIELD

The present invention relates to an indoor unit and an air conditioner.

BACKGROUND

A wall-mounted indoor unit that is mounted on a wall, and includes a filter, as shown in Patent Document 1 for example, is known.

PATENT DOCUMENT

[Patent Document 1] Japanese Unexamined Patent Application, First Publication No. 2011-058719

In an indoor unit such as the aforementioned, a front surface panel is provided so as to freely rotate between open and close, and in order to conduct cleaning or the like or conduct maintenance work on the filter the front surface panel needs to be opened. For such reason, increased time and workload required for conducting filter maintenance work was a problem.

SUMMARY

The present disclosure has been made in order to address the problem above, and an object is to provide an indoor unit which has a configuration that requires reduced time and workload for filter maintenance work, and to provide an air conditioner that includes such an indoor unit.

An indoor unit according to an embodiment of the present disclosure, which is the indoor unit of an air conditioner, and that is a wall-mounted type which is mounted on a wall, the indoor unit includes: a heat exchange device; a blower; a housing that has an intake port, and that houses the heat exchange device and the blower therein, and a filter that is disposed between the intake port and the heat exchange device, wherein the housing has an upper wall portion that is located above out of a wall portion that configures the housing: an insertion port through which the filter is inserted, and that is formed on a top side part of the housing, and a mounting portion that is provided on an edge portion of the insertion port in a front side; the intake port that opens to the top is formed on the upper wall portion, the insertion port opens to a front, and the filter has: a filter main body that is disposed between the intake port and the heat exchange device: a handle portion provided on a front end portion of the filter main body, and that is located in front of the insertion port, and the filter is attached to the housing so as to be detachable from an outside of the housing via the insertion port, and the handle portion has: at least a part of a cover wall portion that overlaps with the insertion port as seen from the front: a base portion mounted above the mounting portion, and a first protrusion which protrudes to a bottom from the base portion and is hooked onto the mounting portion from the rear, and a front surface of the cover wall portion is exposed to an outside of the housing.

An embodiment of the air conditioner according to the present disclosure may include the aforementioned indoor unit, and the aforementioned outdoor unit.

According to the present disclosure, it is possible to reduce time and workload required for filter maintenance work of an indoor unit of an air conditioner.

DETAILED DESCRIPTION

Figure 1:
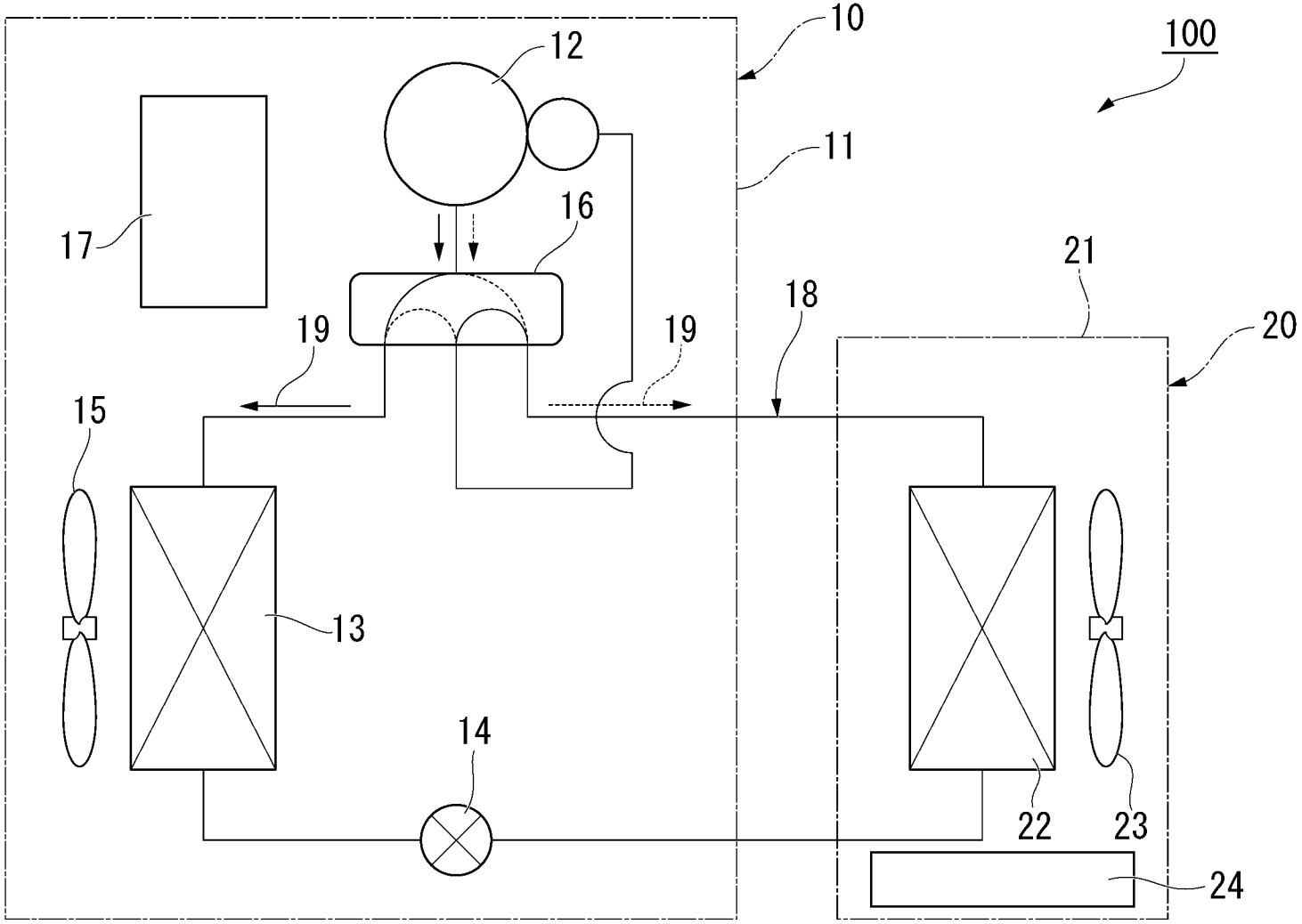
FIG. 1 A schematic diagram that shows a general configuration of an air conditioner in an embodiment.

Hereinafter, embodiments of the present disclosure are explained with reference to the drawings. The scope of the present disclosure is not limited to the embodiments below, and it is possible to apply changes as necessary within the technical scope of the present disclosure. In the drawings below, quantities and scales of various components below are chosen to facilitate understanding of the drawings, and there are cases where the quantities and scales of the various components may differ from actual quantities and scales thereof.

The drawings show an X axis, a Y axis, and a Z axis where appropriate. The X axis shows a side out of sides of a horizontal direction. The Y axis shows another side out of sides of the horizontal direction. The Z axis shows a vertical direction. In the explanation below, a horizontal direction along the X axis is referred to as a "front-rear direction X", and a horizontal direction along the Y axis is referred to as a "left-right direction Y". A vertical direction is referred to as a "vertical direction Z". The front-rear direction X, the left-right direction Y, and the vertical direction Z are mutually orthogonal directions. In the explanation below, a side out of sides of the vertical direction Z in which an arrow of the Z axis faces (+Z side) is a top side. The other side out of sides of the vertical direction Z which faces an opposite side the arrow of the Z axis faces is a bottom side (−Z side). A side out of sides of the front-rear direction X in which an arrow of the X axis faces (+X side) is a "front side". The other side out of sides of the front-rear direction X which faces an opposite side the arrow of the X axis faces (−X side) is a "rear side". The left-right direction Y is a left-right direction of an indoor unit in the embodiment below as seen from the front (+X direction). In other words, a side out of sides of the left-right direction Y in which an arrow of the Y axis faces (+Y side) is a "right side". The other side out of sides of the left-right direction Y which faces an opposite side the arrow of the Y axis faces (−Y side) is a "left side".

FIG. 1 is a schematic diagram that shows a general configuration of an air conditioner 100 in a present embodiment. As shown in FIG. 1, the air conditioner 100 includes an outdoor unit 10, an indoor unit 20, and a circulation pathway 18. The outdoor unit 10 is disposed on an outside of a room. The indoor unit 20 is disposed on an inside of the room. The outdoor unit 10 and the indoor unit 20 are each connected by the circulation pathway 18 that circulates a refrigerant 19.

By having the refrigerant 19 that flows within the circulation pathway 18, and the indoor unit 20 conduct heat exchange with the air indoors, it is possible for the air conditioner 100 to adjust a temperature of the air indoors. A refrigerant such as a fluorine based refrigerant with a low global warming potential (GWP: Global Warming Potential), or a hydrocarbon based refrigerant or the like may be mentioned as examples of the refrigerant 19.

The outdoor unit 10 includes a housing 11, a compressor 12, a heat exchange device 13, a flow adjustment valve 14, a blower 15, a four-way valve 16, and a control portion 17. The compressor 12, the heat exchange device 13, the flow adjustment valve 14, the blower 15, the four-way valve 16, and the control portion 17 are housed on an inner portion of the housing 11.

Out of the circulation pathway 18, the compressor 12, the heat exchange device 13, the flow adjustment valve 14, and the four-way valve 16 are provided on a portion located on the inside portion of the housing 11. Out of the circulation pathway 18, the compressor 12, the heat exchange device 13, the flow adjustment valve 14, and the four-way valve 16 are connected by a portion located on the inside portion of the housing 11.

Out of the circulation pathway 18, the four-way valve 16 is provided on a portion that is connected to a discharge of the compressor 12. By exchanging a part of the circulation pathway 18, it is possible for the four-way valve 16 to reverse a direction of flow of the refrigerant 19 within the circulation pathway 18. When the path connected by the four-way valve 16 is the path of the four-way valve 16 that is shown by solid lines in FIG. 1, the refrigerant 19 within the circulation pathway 18 flows in the direction shown by the solid line arrow in FIG. 1. On the other hand, when the path connected by the four-way valve 16 is the path of the four-way valve 16 that is shown by dashed lines in FIG. 1, the refrigerant 19 flows within the circulation pathway 18 in the direction shown by the dashed line arrow in FIG. 1.

The indoor unit 20 includes a housing 21, a heat exchange device 22, a blower 23, and a control portion 24. The housing 21 houses the heat exchange device 22, the blower 23, and the control portion 24 on an inside portion thereof. It is possible for the indoor unit 20 to have a cooling operation where the air of the room the indoor unit 20 is disposed in is cooled, and to have a heating operation where the air of the room the indoor unit 20 is disposed in is heated.

When the indoor unit 20 is operated in the cooling operation, the refrigerant 19 that flows within the circulation pathway 18 flows in the direction shown by the solid line in FIG. 1. In other words, when the indoor unit 20 is operated in the cooling operation, the refrigerant 19 that flows within the circulation pathway 18 circulates so as to return to the compressor 12 after passing through the compressor 12, the heat exchange device 13 of the outdoor unit 10, the flow adjustment valve 14, and the heat exchange device 22 of the indoor unit 20 in such an order. During the cooling operation, the heat exchange device 13 of the outdoor unit 10 functions as a condenser, and the heat exchange device 22 of the indoor unit 20 functions as an evaporator.

On the other hand, when the indoor unit 20 is operated in the heating operation, the refrigerant 19 that flows within the circulation pathway 18 flows in the direction shown by the dashed line in FIG. 1. In other words, when the indoor unit 20 is operated in the heating operation, the refrigerant 19 that flows within the circulation pathway 18 circulates so as to return to the compressor 12 after passing through the compressor 12, the heat exchange device 22 of the indoor unit 20, the flow adjustment valve 14, and the heat exchange device 13 of the outdoor unit 10 in such an order. During the heating operation, the heat exchange device 13 of the outdoor unit 10 functions as the evaporator, and the heat exchange device 22 of the indoor unit 20 functions as the condenser.

Figure 2:
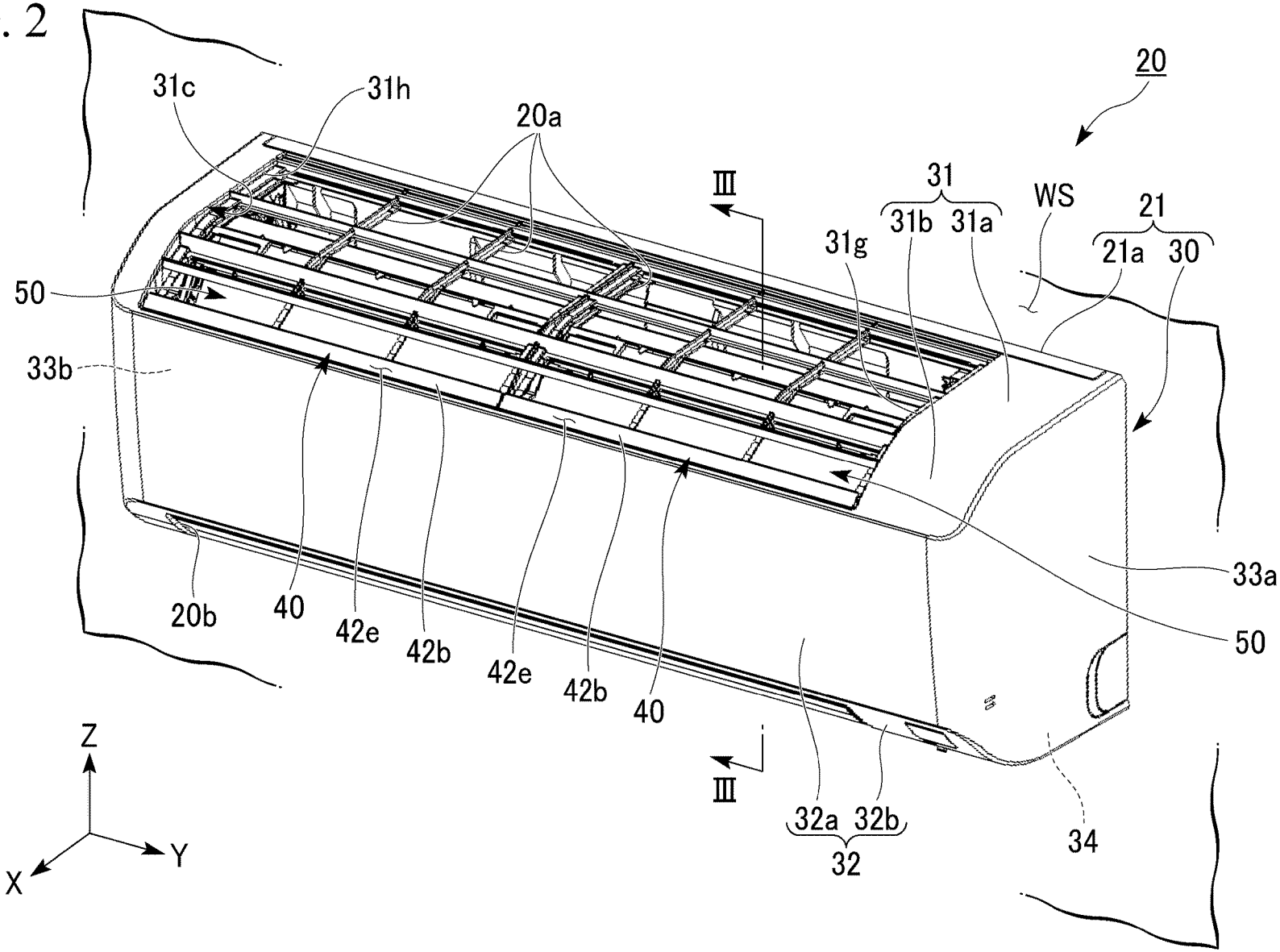
FIG. 2 A perspective view that shows an indoor unit in an embodiment.
Figure 3:
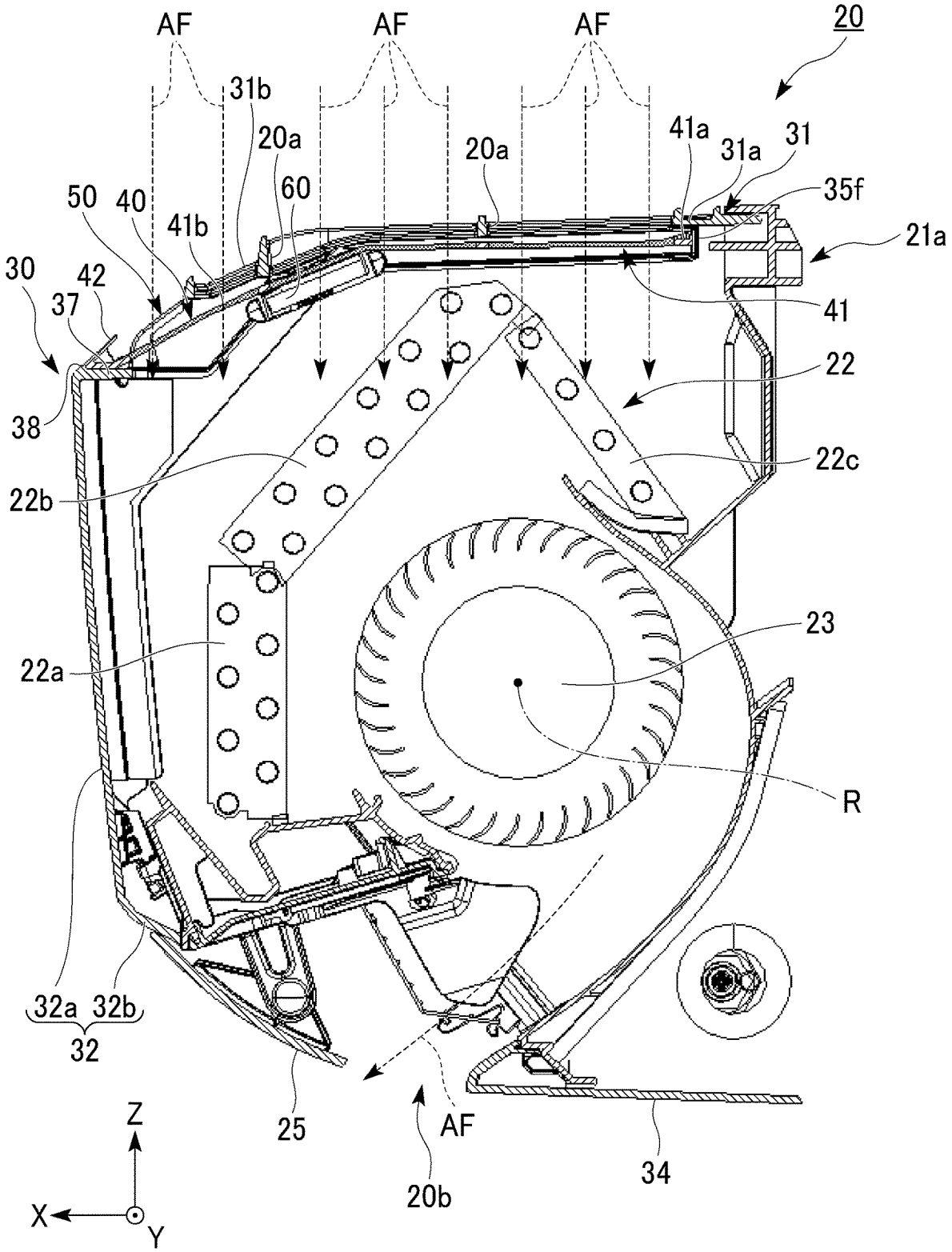
FIG. 3 A cross-sectional view that shows the indoor unit in an embodiment, taken along a cross-section III-III in FIG. 2.

Next, the indoor unit 20 is explained in further detail. FIG. 2 is a perspective view that shows the indoor unit 20. FIG. 3 is a cross-sectional view that shows the indoor unit 20, taken along a cross-section III-III in FIG. 2. As shown in FIG. 2 the indoor unit 20 is wall-mounted indoor unit that is mounted on an indoor wall surface WS. The indoor unit 20 is a long roughly rectangular shape in the left-right direction Y.

As shown in FIG. 3, the blower 23 housed inside the housing 21 of the indoor unit 20 is a cross flow fan. Although omitted from the drawings, the blower 23 extends in the left-right direction Y. The blower 23 rotates around a rotation axis R that extends in the left-right direction Y.

The heat exchange device 22 in the present embodiment has a first heat exchange device 22*a*, a second heat exchange device 22*b*, and a third heat exchange device 22*c*. The first heat exchange device 22*a* is located in front of the blower 23. The second heat exchange device 22*b* and the third heat exchange device 22*c* are located above the blower 23. The second heat exchange device 22*b* extends to the top and to an inclined rear direction from an upper end portion of the first heat exchange device 22*a*, as seen in the left-right direction Y. The third heat exchange device 22*c* is located in a rear of the second heat exchange device 22*b*. The third heat exchange device 22*c* extends to the bottom and to the inclined rear direction from an upper end portion of the second heat exchange device 22*b*, as seen in the left-right direction Y.

As shown in FIG. 2, the housing 21 of the indoor unit 20 has an outer shell member 30, and an air pathway member 21*a*. The outer shell member 30 is a member that configures a part of an outer shell of the housing 21. The outer shell member 30 is a design panel that improves an outer design of the indoor unit 20. The outer shell member 30 is a roughly box-like rectangular shape that opens to a rear of the outer shell member 30. As shown in FIG. 3, the opening in the rear of the outer shell member 30 is blocked by the air pathway member 21*a*.

The air pathway member 21*a* is a member that configures a part of an air pathway through which air that is taken into an inside of the housing 21 by the blower 23 passes. In the present embodiment, the air pathway through which air that is taken into the inside of the housing 21 by the blower 23 passes is configured of the air pathway member 21*a* and the outer shell member 30. The air pathway member 21*a* is fixed to the wall surface WS by being hooked on to an installation plate not shown in the drawings. As such, the indoor unit 20 is fixed to the wall surface WS.

Figure 4:
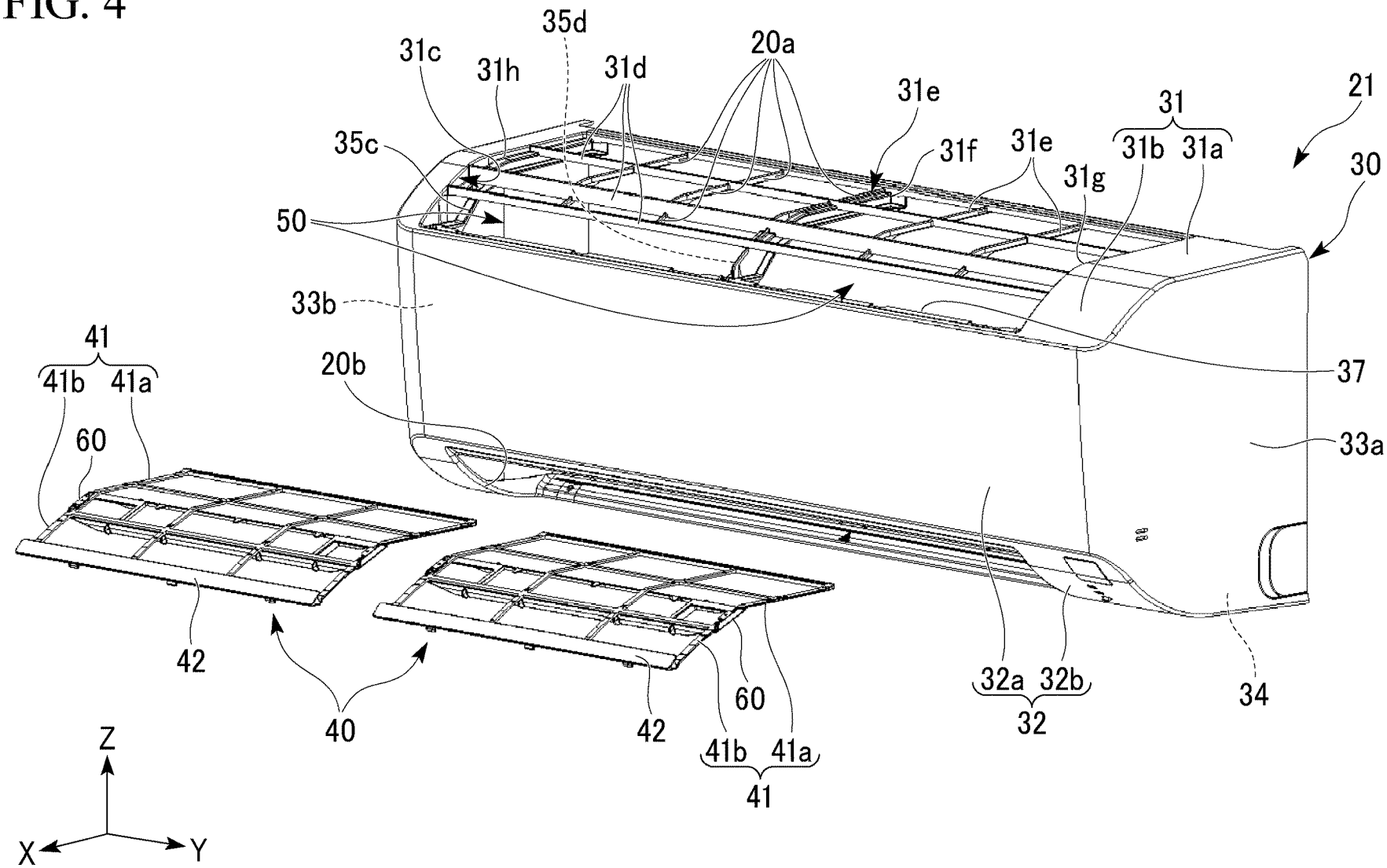
FIG. 4 An exploded perspective view that shows an outer shell member and a filter in an embodiment.

The outer shell member 30 in the present embodiment is integrally molded. In other words, the outer shell member 30 in the present embodiment does not have a detachable part therefrom. FIG. 4 is an exploded perspective view that shows the outer shell member 30 and filters 40 to be mentioned later on. As shown in FIG. 4, the outer shell member 30 has an upper wall portion 31, a front wall portion 32, a pair of side wall portions 33*a* and 33*b*, and a bottom wall portion 34. The various wall portions that configure the outer shell member 30 in the present embodiment are plate shaped.

The upper wall portion 31 is a wall portion that is located on top out of wall portions that configure the housing 21. The upper wall portion 31 extends in the left-right direction Y. The upper wall portion 31 in the present embodiment roughly configures an entirety of an outer shell in a top side out of the outer shell of the housing 21. Specifically, as shown in FIG. 2, the outer shell in the top side out of the outer shell of the housing 21 is configured by an upper end portion of the upper wall portion 31 and the air pathway member 21*a*. The upper end portion of the air pathway member 21*a* roughly configures an entirety of an edge portion out of outer shells of a top side of the housing 21 in a rear side thereof.

The upper wall portion 31 has an upper wall main body portion 31*a*, and an upper wall inclined portion 31*b*. The upper wall main body portion 31*a* is a rear side part of the upper wall portion 31. A top surface of the upper wall main body portion 31*a* roughly orthogonal to the vertical direction Z. The upper wall inclined portion 31*b* is a front side part of the upper wall portion 31. The upper wall inclined portion 31*b* protrudes to the front and in an inclined bottom direction from a front end portion of the upper wall main body portion 31*a*. In other words, the upper wall inclined portion 31*b* is located to the bottom as the upper wall inclined portion 31*b* heads towards the front. A top surface of the upper wall inclined portion 31*b* faces the top as well as an inclined front direction. A dimension of the upper wall inclined portion 31*b* in the front-rear direction X is smaller than a dimension of the upper wall main body portion 31*a* in the front-rear direction X. A connecting part between a top surface of the upper wall portion 31 and the top surface of the upper wall inclined portion 31*b* is rounded. Since the upper wall portion 31 has the upper wall inclined portion 31*b*, cornered portion of rectangular shapes in an upper end portion of the housing 21 become shapes such as shapes that have been chamfered.

The front wall portion 32 is a wall portion that configures an outer shell out of outer shells of the housing 21 in a front side thereof. As shown in FIG. 3, the front wall portion 32 is located in front of the heat exchange device 22. Specifically, the front wall portion 32 is located in front of the first heat exchange device 22*a* and the second heat exchange device 22*b*. An upper end portion of the front wall portion 32 is connected to a front end portion of the upper wall portion 31.

The front wall portion 32 has a front wall main body portion 32*a* and a front wall inclined portion 32*b*. The front wall main body portion 32*a* is a part that includes a top side part of the front wall portion 32. An upper end portion of the front wall main body portion 32*a* is connected to a front end portion of the upper wall inclined portion 31*b*. The front wall main body portion 32*a* is located in front of the first heat exchange device 22*a* and the second heat exchange device 22*b*. A front surface of the front wall main body portion 32*a* is roughly orthogonal to the front-rear direction X. Specifically, the front surface of the front wall main body portion 32*a* is slightly located to the rear as the front wall main body portion 32*a* heads towards the bottom.

As shown in FIG. 4, the front wall inclined portion 32*b* is a part of a bottom side part of the front wall portion 32. A dimension of the front wall inclined portion 32*b* in the vertical direction Z is smaller than a dimension of the front wall main body portion 32*a* in the vertical direction Z. The front wall inclined portion 32*b* protrudes to the bottom and the inclined rear direction from a bottom end portion of the front wall main body portion 32*a*. In other words, the front wall inclined portion 32*b* is located to the rear as the front wall inclined portion 32*b* heads towards the bottom. A front surface of the front wall inclined portion 32*b* faces the front as well as the inclined bottom direction. Since the front wall portion 32 has the front wall inclined portion 32*b*, cornered portions of rectangular shapes in a bottom end portion of the housing 21 become shapes such as shapes that have been chamfered.

The pair of the side wall portions 33*a* and 33*b* individually configure an outer shell of each side out of the outer shells of the housing 21 in the left-right direction Y. A side wall portion 33*a* configures the outer shell on a right side (+Y side) out of the outer shells of the housing 21. A side wall portion 33*b* configures the outer shell on the left side (−Y side) out of the outer shells of the housing 21. A right surface of the side wall portion 33*a* and a left surface of the side wall portion 33*b* are orthogonal to the left-right direction Y. The pair of the side wall portions 33*a* and 33*b* each protrude to the rear from both end portions of the front wall portion 32 in the left-right direction Y. The side wall portion 33*a* protrudes to the rear from a right end portion of the front wall portion 32. The side wall portion 33*b* protrudes to the rear from a left end portion of the front wall portion 32. An upper end portion of the side wall portion 33*a* is connected to a right end portion of the upper wall portion 31. An upper end portion of the side wall portion 33*b* is connected to a left end portion of the upper wall portion 31.

The bottom wall portion 34 configures an outer shell of a bottom side out of the outer shells of the housing 21. The bottom wall portion 34 protrudes to the rear from a bottom end portion of the front wall portion 32. Specifically, the bottom wall portion 34 protrudes to the rear side from a bottom end portion of the front wall inclined portion 32*b*. As shown in FIG. 3, a bottom surface of the bottom wall portion 34 is roughly orthogonal to the vertical direction Z. Specifically, the bottom surface of the bottom wall portion 34 is slightly located to the bottom as the bottom wall portion 34 heads towards the rear. As shown in FIG. 4, a connecting part between the front end portion on the bottom surface of the bottom wall portion 34 and the bottom end portion on the front surface of the front wall inclined portion 32*b* is rounded.

The housing 21 has intake port 20*a* and exhaust port 20*b*. In the present embodiment, the intake port 20*a* and the exhaust port 20*b* are formed by the outer shell member 30. The intake port 20*a* is formed into the upper wall portion 31. The exhaust port 20*b* is formed into the front wall inclined portion 32*b* of the front wall portion 32.

The intake port 20*a* is open to the top. A plurality of intake ports 20*a* are provided in the present embodiment. The plurality of intake ports 20*a* are disposed so as to be aligned in a matrix shape in the front-rear direction X and in the left-right direction Y. In other words, the intake port 20*a* is provided in such a manner as to have a plurality of rows align in the left-right direction Y, and a plurality of rows align in the front-rear direction X. In the present embodiment, six rows of intake ports 20*a* that align in the left-right direction Y, and three rows that align in the front-rear direction X are provided. The row of the intake ports 20*a* located rear most out of the aforementioned three rows is formed into the upper wall main body portion 31*a*. The row of the intake ports 20*a* located in a center in the front-rear direction X out of the aforementioned three rows is formed so as to straddle the upper wall main body portion 31*a* and the upper wall inclined portion 31*b*. The row of the intake ports 20*a* located front most out of the aforementioned three rows is formed into the upper wall inclined portion 31*b*. Air is taken into the housing 21 from the plurality of intake ports 20*a* by the operation of the blower 23.

The exhaust port 20*b* is open to the front and to the bottom. The exhaust port 20*b* extends in the left-right direction Y. A dimension of the exhaust port 20*b* in the left-right direction Y is larger than half a dimension of the housing 21 in the left-right direction Y. Air taken into the housing 21 by the blower 23 is discharged from the exhaust port 20*b*. As shown in FIG. 3, a wind direction adjusting unit 25 that allows the exhaust port 20*b* to be openable is disposed in the exhaust port 20*b*. A direction of the wind being blown into the room from the exhaust port 20*b* is adjusted by the wind direction adjusting unit 25.

The housing 21 has an insertion port 50 to insert a filter 40 that is mentioned later on. The insertion port 50 is open to the front. The insertion port 50 is exposed to the front of the indoor unit 20. The insertion port 50 in the present embodiment is formed into a top side part of the housing 21. Specifically, the insertion port 50 is formed into the upper wall inclined portion 31*b* in the upper wall portion 31 of the outer shell member 30. The insertion port 50 is open to the front and open to the top. As shown in FIG. 4, the insertion port 50 in the present embodiment is aligned and disposed in front of the plurality of intake ports 20*a* aligned in a matrix shape. The insertion port 50 extends in the left-right direction Y. The insertion port 50 is a long roughly rectangular shape that extend in the left-right direction Y as seen from the front.

It is possible to insert the filter 40 to be mentioned later on from an outer portion of the housing 21 into the insertion port 50. A dimension of the insertion port 50 in the left-right direction Y is larger than a dimension of the filter 40 in the left-right direction Y. The dimension of the insertion port 50 in the left-right direction Y in the present embodiment is roughly the same as the dimension of the filter 40 in the left-right direction Y. A dimension of the insertion port 50 in the vertical direction Z is larger than a dimension of a filter 40 in the vertical direction Z. In the present embodiment, two insertion ports 50 are provided side by side in the left-right direction Y.

In the embodiment, the plurality of intake ports 20*a* and the two insertion ports 50 are formed by having a through hole 31*c* formed in the upper wall portion 31 be partitioned by a plurality of first beam portions 31*d* and a plurality of second beam portions 31*e*. The through hole 31*c* penetrates the upper wall portion 31 in the vertical direction Z. The through hole 31*c* is a long roughly rectangular shaped hole in the left-right direction Y as seen from the top. A center of the through hole 31*c* in the left-right direction Y is located more to the left side (−Y side) than a center of the upper wall portion 31 in the left-right direction Y. A dimension of the through hole 31*c* in the left-right direction Y is larger than half the dimension of the housing 21 in the left-right direction Y. The dimension of the through hole 31*c* in the left-right direction Y is the same as the dimension of the exhaust port 20*b* in the left-right direction Y. An edge portion of the through hole 31*c* in the front side is located on an edge portion of the upper wall portion 31 in the front side. The edge portion of the through hole 31*c* in the front side forms edge portions of the two insertion ports 50 in the front side. Edge portions of the through hole 31*c* in the rear side are located on edge portions of the upper wall portion 31 in the rear side.

The plurality of first beam portions 31*d* extend in the left-right direction Y. The plurality of first beam portions 31*d* are disposed at intervals in the front-rear direction X. Three of the plurality of first beam portions 31*d* are disposed. Both end portions of the plurality of first beam portions 31*d* in the left-right direction Y are each connected to parts out of inner edges of the through hole 31*c* located on both sides in the left-right direction Y.

The plurality of second beam portions 31*e* extend in the front-rear direction X as seen from the top. The plurality of second beam portions 31*e* are disposed at intervals in the left-right direction Y. Five second beam portions 31*e* are provided. Each of the second beam portions 31*e* connects the plurality of the first beam portions 31*d* to one another. Rear end portions of the plurality of second beam portions 31*e* are connected to parts out of the inner edges of the through hole 31*c* located on a rear side. A second beam portion 31*e* located in a center out of the plurality second beam portions 31*e* in the left-right direction Y is a center beam portion 31*f*. A front end portion of the center beam portion 31*f* is connected to a part out of the inner edges of the through hole 31*c* located on a front side. The two insertion ports 50 are partitioned in the left-right direction Y by the center beam portion 31*f*. Front end portions of the second beam portions 31*e* other than the center beam portion 31*f* are connected to the first beam portions 31*d* out of the plurality of first beam portions 31*d* located front most. The center beam portion 31*f* protrudes to the bottom more than the other second beam portions 31*e*.

In the explanation below, a part located in the right direction (+Y direction) more than the center beam portion 31*f* out of the through hole 31*c* is referred to as a "right through hole 31*g*". A part located in the left direction (−Y direction) more than the center beam portion 31*f* out of the through hole 31*c* is referred to as a "left through hole 31*h*".

Figure 5:
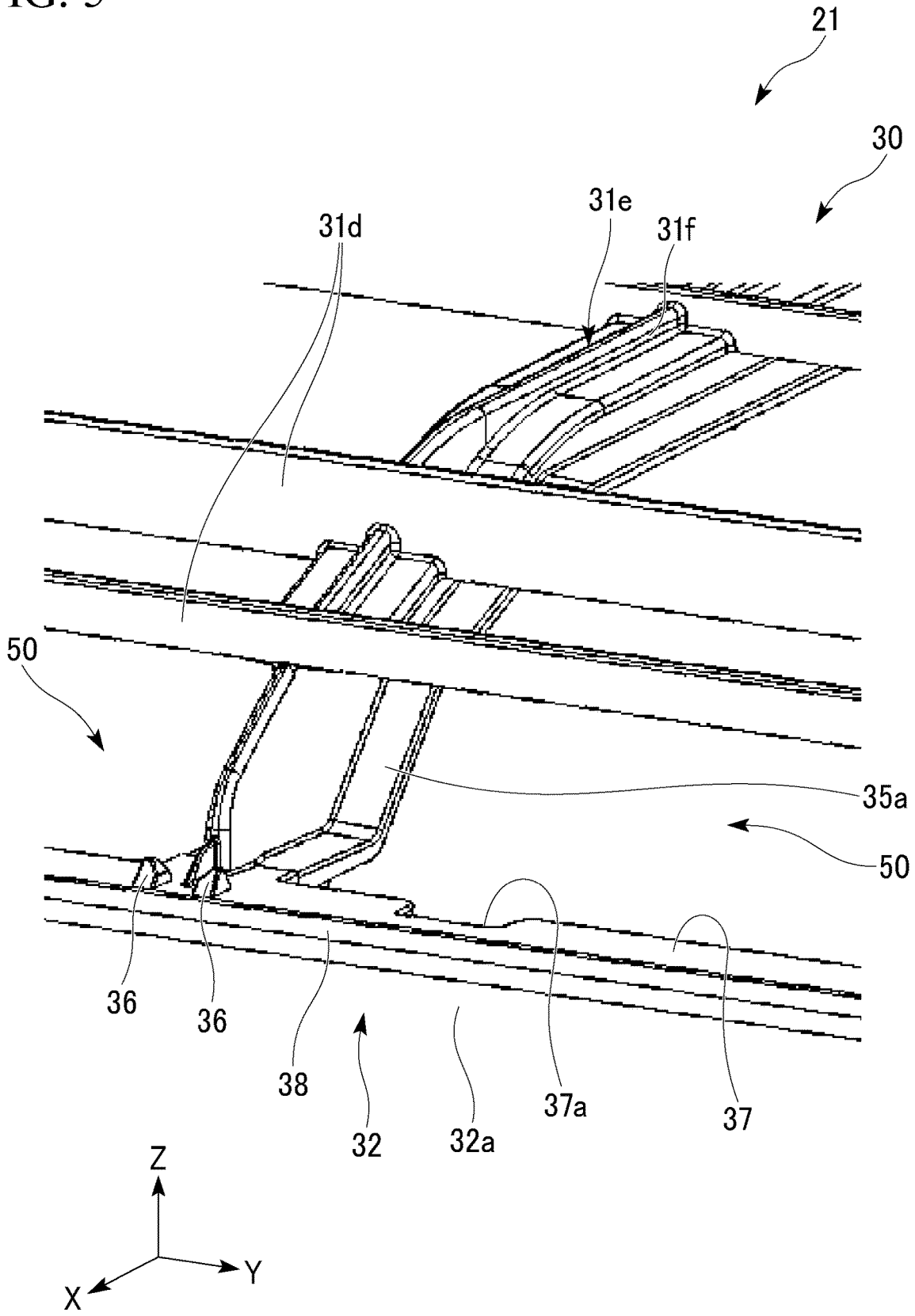
FIG. 5 A perspective view that shows a portion of the outer shell member in an embodiment.
Figure 6:
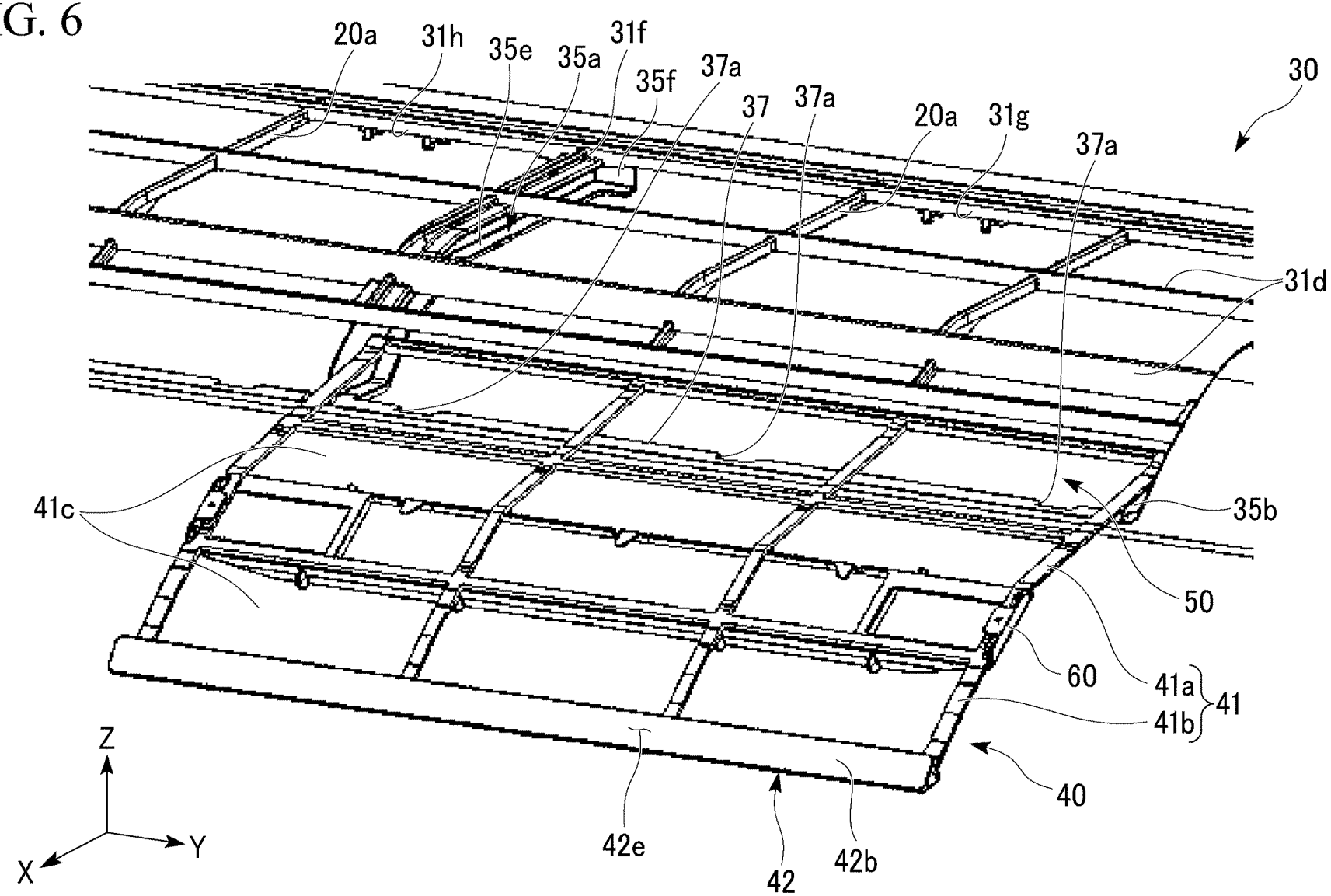
FIG. 6 A perspective view that shows a portion of the outer shell member and the filter when being inserted inside an insertion port out of insertion portions in an embodiment.
Figure 7:
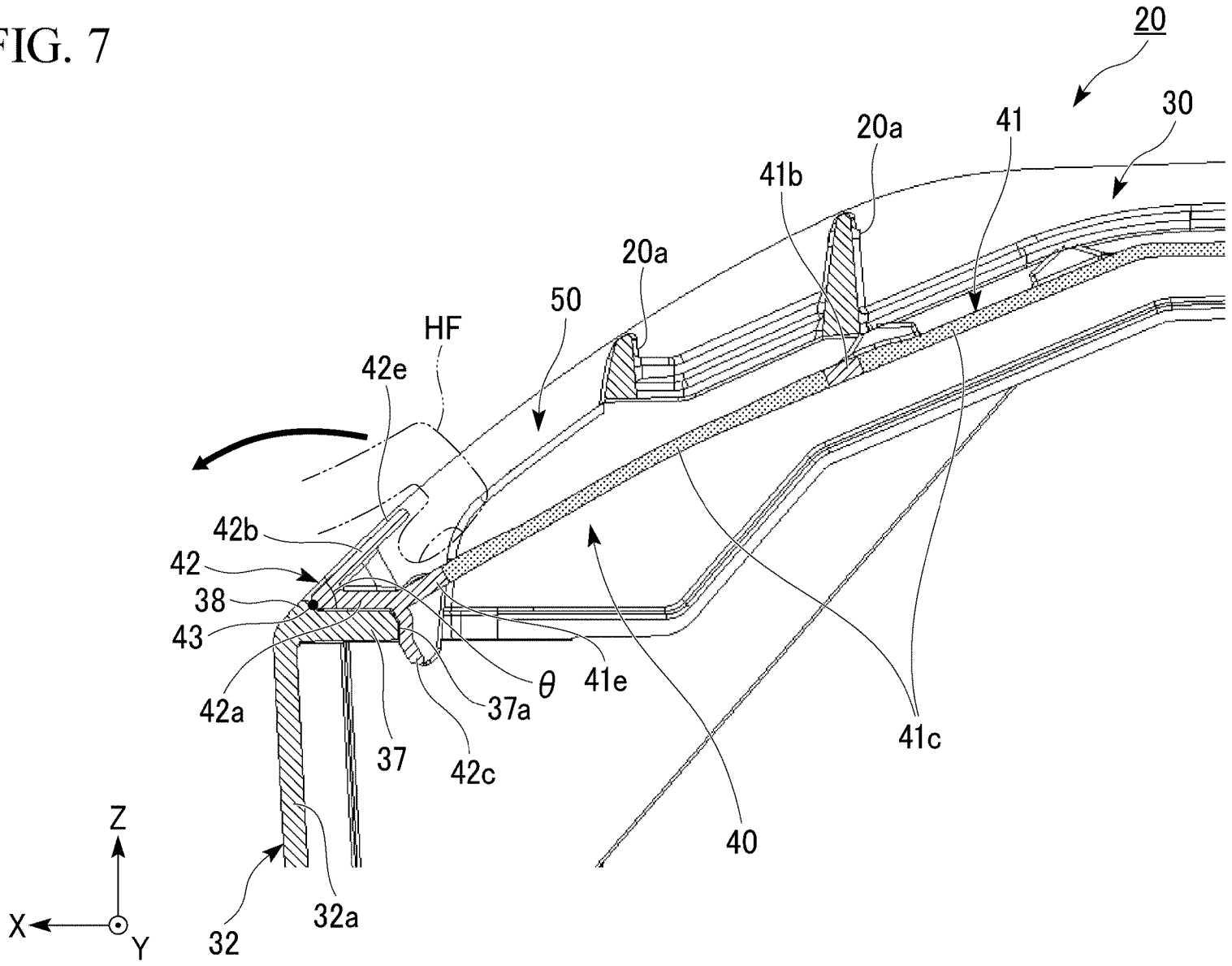
FIG. 7 A cross-sectional view that shows a portion of the indoor unit, and shows a first protrusion in an embodiment.
Figure 8:
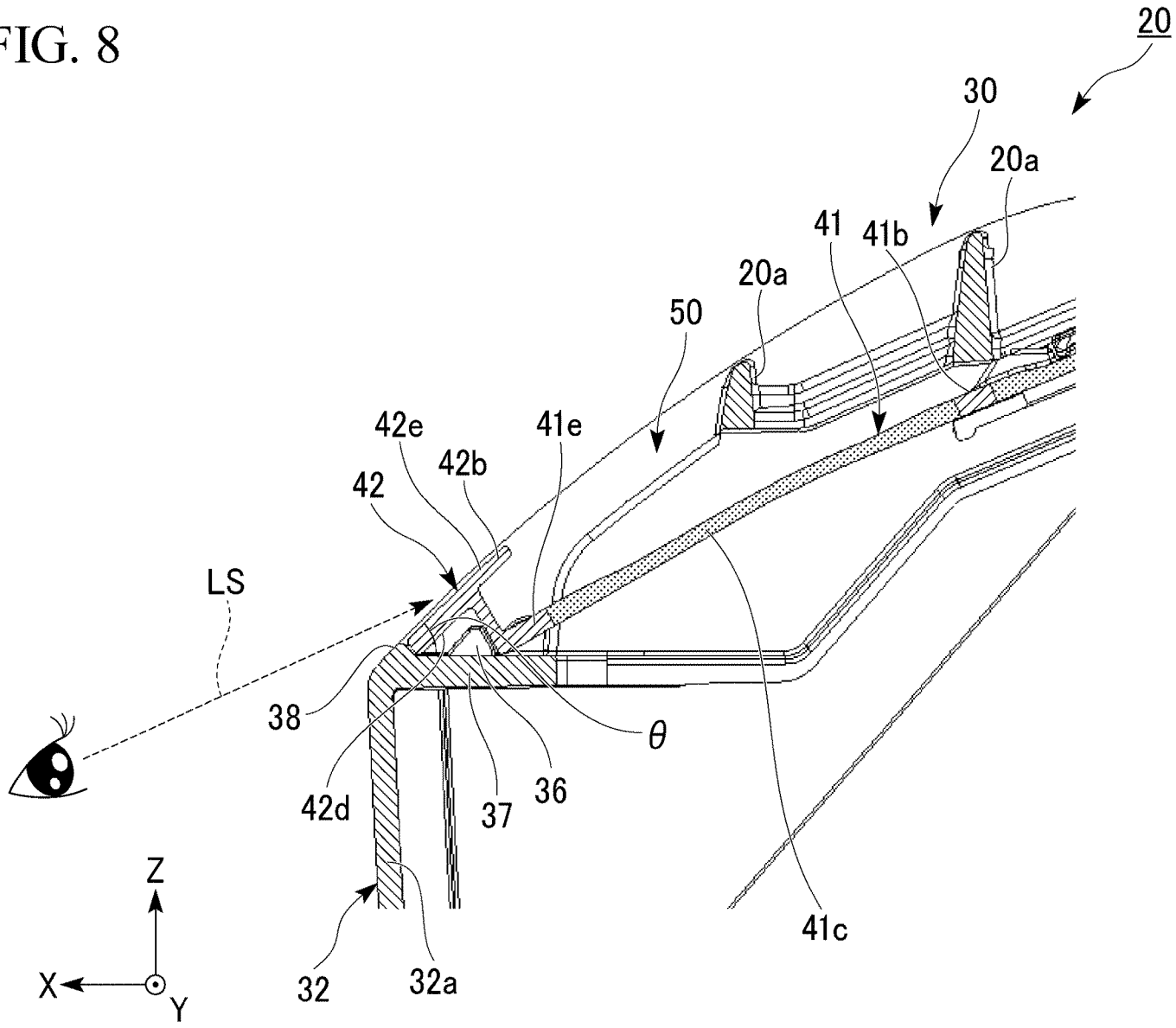
FIG. 8 A cross-sectional view that shows a portion of the indoor unit, and shows a second protrusion in an embodiment.

FIG. 5 is a perspective view that shows a part of the outer shell member 30. FIG. 6 is a perspective view that shows a part of the outer shell member 30 and the filter 40 when being inserted inside an insertion port 50 out of the insertion ports 50. FIG. 7 is a cross-sectional view that shows a part of the indoor unit 20, and shows a first protrusion 42*c* to be mentioned later on. FIG. 8 is cross-sectional view that shows a part of the indoor unit 20, and shows a second protrusion 36 to be mentioned later on.

As shown in FIG. 5, the housing 21 has a mounting portion 37 that is provided on an edge portion of the insertion port 50 in the front side. The mounting portion 37 protrudes to the rear from the edge portion of the insertion port 50 in the front side. The mounting portion 37 extends in the left-right direction Y. The mounting portion 37 is a long roughly rectangular shaped plate in the left-right direction Y. A plate surface of the mounting portion 37 is orthogonal to the vertical direction Z. As shown in FIG. 4, the mounting portion 37 extends from a right end portion to a left end portion of the through hole 31*c*. The front end portion of the center beam portion 31*f* is connected to the mounting portion 37.

As shown in FIG. 5 and in FIG. 6, the mounting portion 37 has a recess portion 37*a* that recesses to the front from an edge portion of a rear side of the mounting portion 37. A plurality of recess portions 37*a* are provided at intervals in the left-right direction Y. Six recess portions 37*a* are provided in the present embodiment. Three recess portions 37*a* out of the six recess portions 37*a* are formed in parts out of the mounting portion 37 that are located more to the right direction (+Y direction) than the center beam portion 31*f*. Remaining three recess portions 37*a* out of the six recess portions 37*a* are formed in parts out of the mounting portion 37 that are located more to the left direction (−Y direction) than the center beam portion 31*f*. As shown in FIG. 7, the first protrusion 42*c* to be mentioned later on is inserted through to the vertical direction Z from the top, on an inside of the recess portion 37*a*.

As shown in FIG. 6, the housing 21 has a pair of guide portions 35*a* and 35*b*. Each of the pair of the guide portions 35*a* and 35*b* is provided on parts located on both sides out of inner edges of the right through hole 31*g* in the left-right direction Y. A guide portion 35*a* is provided on an edge portion out of the inner edge portions located on the left side (−Y side) of the right through hole 31*g*. An edge portion located on a left side of the inner edge portions of the right through hole 31*g* is an edge portion of the right side (+Y side) of the center beam portion 31*f*. A guide portion 35*b* is provided on an edge portion out of the inner edge portions located on the right side of the right through hole 31*g*. Each of the pair of the guide portions 35*a* and 35*b* protrudes from each edge portion of the right through hole 31*g* so as to come closer to one another in the left-right direction Y. The guide portion 35*a* and the guide portion 35*b* are disposed so as to be symmetrical in the left-right direction Y. As such, in the explanations hereinafter, there are cases where an explanation of the pair of the guide portions 35*a* and 35*b* is represented by an explanation of one of the pair, the guide portion 35*a*, with the explanation of the other of the pair, the guide portion 35*b* being abbreviated.

The guide portion 35*a* extends in the front-rear direction X as seen from the top. A front end portion of the guide portion 35*a* is connected to the mounting portion 37. A rear end portion of the guide portion 35*a* is connected to an edge portion located on a rear side out of the inner edges of the right through hole 31*g*. The guide portion 35*a* has a guide wall portion 35*e* and an opposing wall portion 35*f*. The guide wall portion 35*e* is a long thin plate shape that extends in the front-rear direction X. A plate surface of the guide wall portion 35*e* faces the vertical direction Z. The guide wall portion 35*e* is disposed further away in the bottom, more than the first beam portions 31*d*. A filter main body 41 of the filter 40 to be mentioned later on is disposed between the guide wall portion 35*e* and the first beam portions 31*d* in the vertical direction Z. The opposing wall portion 35*f* protrudes to the top, from a rear end portion of the guide wall portion 35*e*. An upper end portion of the opposing wall portion 35*f* is connected to an edge portion located on the rear side out of inner edges of the right through hole 31*g*. A front surface of the opposing wall portion 35*f* is a surface orthogonal to the front-rear direction X.

As shown in FIG. 4, the housing 21 has a pair of guide portions 35*c* and 35*d*. Except for an aspect of being disposed with respect to the left through hole 31*h*, the pair of the guide portions 35*c* and 35*d* are similar to the pair of the guide portions 35*a* and 35*b*.

As shown in FIG. 5, the housing 21 has the second protrusion 36 that protrudes to the top from the mounting portion 37. The second protrusion 36 is provided on parts of each of the guide portions 35*a*, 35*b*, 35*c*, and 35*d* out of the mounting portion 37 mentioned above, located in the front. In other words, four second protrusions 36 are provided in the present embodiment. Out of the four second protrusions 36, two second protrusions 36 are located in the right direction (+Y direction) more than the center beam portion 31*f* out of the mounting portion 37. Out of the four second protrusions 36, the remaining two second protrusions 36 are located in the left direction (−Y direction) more than the center beam portion 31*f* out of the mounting portion 37. As shown in FIG. 8, the second protrusion 36 is roughly a triangular shape, as seen in the left-right direction Y. The second protrusions 36 are roughly quadrangular pyramids that protrude to the top.

The housing 21 has a support protrusion 38 that protrudes to the top from the mounting portion 37. The support protrusion 38 in the present embodiment protrudes to the top from a front end portion of the mounting portion 37. The support protrusion 38 is roughly a triangular shape as seen in the left-right direction Y. An upper end portion of the support protrusion 38 is located more in the bottom than an upper end portion of the second protrusion 36. The support protrusion 38 is located in front of the second protrusion 36. As shown in FIG. 5, the support protrusion 38 extends in the left-right direction Y. The support protrusion 38 extends from a right end portion of the mounting portion 37 to a left end portion thereof.

As shown in FIG. 3, the indoor unit 20 includes the filter 40 that is disposed in between the intake port 20*a* and the heat exchange device 22. The filter 40 in the present embodiment is located in between the intake port 20*a* and the heat exchange device 22 in the vertical direction Z. Air that is taken into the housing 21 from the intake port 20*a* passes through the filter 40 to the heat exchange device 22. It is possible for the filter 40 to at least capture parts of dust included in the air which passes through the filter 40. As such, it is possible to remove at least a parts of the dust included in the air passing air through the filter 40 by passing the air through the filter 40.

As shown in FIG. 2 and FIG. 4, in the present embodiment, two filters 40 are provided alongside one another in the left-right direction Y. The two filters 40 are insertable from an outside portion of the housing 21 through each of the two insertion ports 50. Each of the filter 40 is inserted inside the housing 21 from each of the insertion ports 50. One of the two filters 40 is disposed on the right through hole 31*g*. The other of the two filters 40 is disposed on the left through hole 31*h*. Each of the filters 40 is attached to the housing 21 so as to be detachable from an outside of the housing 21 via each of the insertion ports 50. Dimensions of each of the filters 40 in the left-right direction Y are smaller than dimensions of each of the insertion ports 50 in the left-right direction Y. The two filters 40 are configured to be identical to one another. In the explanations below, the filter 40 located in the right direction (+Y direction) is explained, and represents the two filters 40.

Figure 9:
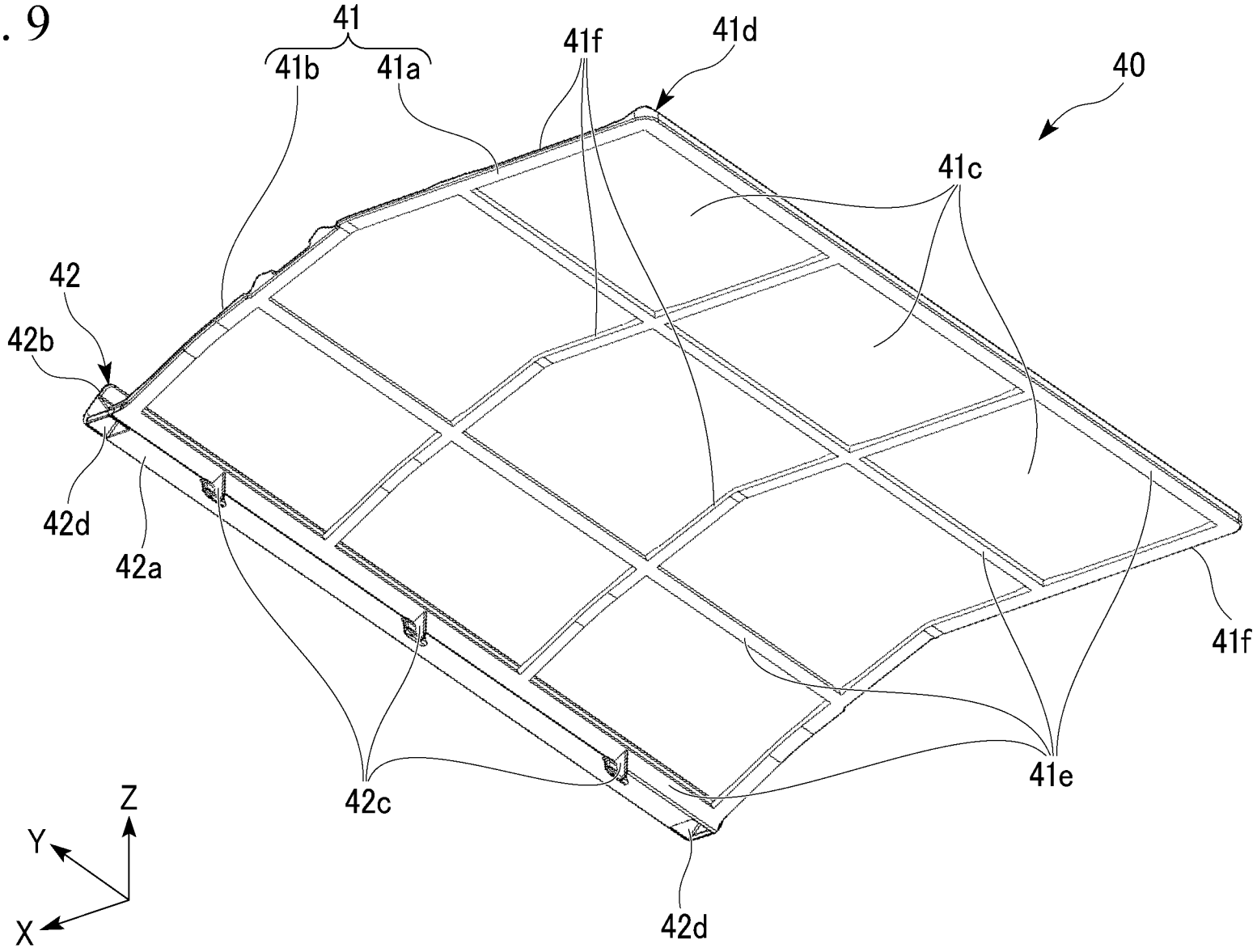
FIG. 9 A perspective view that shows the filter in an embodiment.

FIG. 9 is a perspective view that shows the filter 40. As shown in FIG. 4 and FIG. 9, the filter 40 is a roughly rectangular plate member. The plate surface of the filter 40 faces the vertical direction Z. The filter 40 has the filter main body 41 and a handle portion 42. The filter main body 41 is roughly a rectangular shape. The filter main body 41 is a part that is disposed between the intake port 20*a* and the heat exchange device 22.

A shown in FIG. 9, the filter main body 41 has a grid portion 41*d* and capturing portions 41*c*. The grid portion 41*d* is for example, made of resin. The grid portion 41*d* and the handle portion 42 are integrally formed in the present embodiment. The grid portion 41*d* is a lattice part that is formed by four beam portions 41*e* that extend in the left-right direction Y, and four beam portions 41*f* that extend in the front-rear direction X.

The capturing portions 41*c* are reticular shaped parts that pass air through. By passing air through the capturing portions 41*c*, it is possible for the capturing portions 41*c* to capture at least parts of the dust included in the air, in the capturing portions 41*c*. A capturing portion 41*c* of the capturing portions 41*c* are provided in each hole in a grid shape of the grid portion 41*d*. Each hole of the grid portion 41*d* is formed and surrounded by each of the beam portions 41*e* adjacent in the front-back direction X and the beam portions 41*f* adjacent in the left-right direction Y. In the present embodiment, three rows of the capturing portion 41*c* are provided so as to align in the left-right direction Y, and three rows of the capturing portions 41*c* are provided so as to align in the front-rear direction X. In other words, nine capturing portions 41*c* are provided in each of the filters 40.

The nine capturing portions 41*c* of the filter 40 that is located in the right direction (+Y direction) out of the two filters 40 are each disposed below nine intake ports 20*a* that form and partition the right through hole 31*g*. The nine capturing portions 41*c* of the filter 40 that is located in the left direction (−Y direction) out of the two filters 40 are each disposed below the nine intake ports 20*a* that form and partition the left through hole 31*h*. In each of the filters 40, front side parts of three capturing portions 41*c* out of the nine capturing portions 41*c* located front most face each of the insertion ports 50.

The filter main body 41 has a first part 41*a* and a second part 41*b*. The first part 41*a* is a rear side part of the filter main body 41. The first part 41*a* expands along a plane orthogonal to the vertical direction Z (XY plane). The second part 41*b* extends in the front as well as the inclined bottom direction from a front end portion of the first part 41*a*. As shown in FIG. 3, the first part 41*a* is located below the upper wall main body portion 31*a*. The second part 41*b* is located below the upper wall inclined portion 31*b*. A front side part of the second part 41*b* is located below the insertion port 50.

Both end portions of the filter main body 41 in the left-right direction Y are supported from below by guide wall portions 35*e* of each of the pair of the guide portions 35*a* and 35*b*. Both end portions of the filter main body 41 in the left-right direction Y are located between the guide wall portions 35*e* of each of the pair of the guide portions 35*a* and 35*b*, and the first beam portions 31*d*. Both rear ends portions of the filter main body 41 in the left-right direction Y are connected to front surfaces of opposing wall portions 35*f* of each of the pair of the guide portions 35*a* and 35*b*.

As shown in FIG. 9, the handle portion 42 is provided on a front end portion of the filter main body 41. Specifically, the handle portion 42 is provided on a front end portion of the second part 41*b* on the filter main body 41. The handle portion 42 is for example made of resin. The handle portion 42 extends in the left-right direction Y. The handle portion 42 extends from a right end portion of the filter main body 41 to a left end portion thereof. As shown in FIG. 7, the handle portion 42 is located in front of the insertion port 50. The handle portion 42 is mounted on a top surface of the mounting portion 37. The handle portion 42 is exposed to the outside of the housing 21. The handle portion 42 has a base portion 42*a*, a cover wall portion 42*b*, and the first protrusion 42*c*.

The base portion 42*a* in the present embodiment is mounted on top of the mounting portion 37. As shown in FIG. 9, the base portion 42*a* is a long roughly rectangular shaped plate that extends in the left-right direction Y. A plate surface of the base portion 42*a* is orthogonal to the vertical direction Z. An edge portion of a rear side of the base portion 42*a* is connected to a beam portion 41*e* located front most out of a plurality of beam portions 41*e* that configure the grid portion 41*d*. A hole 42*d* is formed on a bottom surface of the base portion 42*a*. A hole 42*d* in the present embodiment is formed on the bottom surface of the base portions 42*a* on each of both end portions in the left-right direction Y. A shape of an inner space of the hole 42*d* is roughly a quadrangular pyramid that protrudes to the top.

As shown in FIG. 8, the second protrusion 36 is inserted from below the hole 42*d*. A part out of an inner surface of the hole 42*d* located in the rear side contacts a rear surface of the second protrusion 36. As such, the inner surface of the hole 42*d* is hooked onto the second protrusion 36 from the rear side (−X side). A dimensions of the hole 42*d* in the vertical direction Z is larger than a dimension of the second protrusion 36 in the vertical direction Z. A part located on a front side out of the inner surface of the hole 42*d* faces a front surface of the second protrusion 36 with a gap in between.

As shown in FIG. 7, the cover wall portion 42*b* protrudes to the top from the base portion 42*a*. Specifically, the cover wall portion 42*b* protrudes to the top as well to the inclined rear direction from a front end portion of the base portion 42*a*. In other words, the cover wall portion 42*b* inclines to the rear as the cover wall portion 42*b* heads towards the top. A dimension of the cover wall portion 42*b* in a direction where the cover wall portion 42*b* protrudes from the base portion 42*a* is larger than a dimension of the base portion 42*a* in the front-rear direction X. A location of an upper end portion of the cover wall portion 42*b* in the front-rear direction X is located slightly in the rear than a location of a rear end portion of the base portion 42*a* in the front-rear direction X.

As shown in FIG. 2, the cover wall portion 42*b* extends in the left-right direction Y. The cover wall portion 42*b* extends from the right end portion of the base portion 42*a* to the left end portion thereof. The cover wall portion 42*b* is a long roughly rectangular shaped plate in the left-right direction Y. At least a part of the cover wall portion 42*b* overlaps with the insertion ports 50, as seen from the front. In the present embodiment, the entirety of the cover wall portion 42*b* overlaps with the insertion port 50, as seen from the front. A front surface of the cover wall portion 42*b* is a decorative surface 42*e*. The decorative surface 42*e* is a flat surface. The decorative surface 42*e* faces the front and an inclined top direction. A surface roughness of the decorative surface 42*e* is less than the surface roughness of other surfaces of the handle portion 42. The decorative surface 42*e* is a shiny surface. The decorative surface 42*e* is exposed to the outside of the housing 21.

As shown in FIG. 7, an angle of inclination θ of the cover wall portion 42*b* with respect to the base portion 42*a* is for example, about 45 degrees. The inclination angle θ of the cover wall portion 42*b* with respect to the base portion 42*a* is an angle that is forms an angle between the bottom surface of the base portion 42*a* and the decorative surface 42*e* of the cover wall portion 42*b*. The inclination angle θ is almost the same as the angle that the upper wall inclined portion 31*b* is inclined at with respect to a plane (XY plane) which is orthogonal with the vertical direction Z.

The first protrusion 42*c* protrudes from the base portion 42*a* to the bottom direction. The first protrusion 42*c* in the present embodiment protrudes to the bottom from a rear end portion of the base portion 42*a*. An upper end portion of the first protrusion 42*c* is connected to the rear end portion of the base portion 42*a* and the front end portion of the filter main body 41. The upper end portion of the first protrusion 42*c* is connected to a bottom surface of the beam portion 41*e* located front most out of the plurality of beam portions 41*e* in the filter main body 41. The first protrusion 42*c* is inserted to an inside of the recess portion 37*a* formed in the mounting portion 37 from above. The first protrusion 42*c* protrudes to the bottom more than the mounting portion 37 via the inside of the recess portion 37*a*. The first protrusion 42*c* is hooked from a rear, to a portion located in the front side out of inner edges of the recess portions 37*a*. As such, the first protrusion 42*c* is hooked from the rear to the mounting portion 37. As shown in FIG. 9, a plurality of first protrusion 42*c* is provided in the left-right direction Y at intervals. Specifically, three first protrusions 42*c* are provided for each of the filters 40. Each of the first protrusions 42*c* is passed from above through an inside of each of the recess portions 37*a*.

As shown in FIG. 7, a bottom end portion in a front end portion of the handle portion 42 is a supported end portion 43 that is hooked onto the support protrusion 38 from the rear (−X direction). The supported end portion 43 in the present embodiment is a corner portion that is connected to the front end portion of the base portion 42*a* and a bottom end portion of the cover wall portion 42*b*. The handle portion 42 protrudes to the top more than the support protrusion 38. A top surface of the base portion 42*a* in the present embodiment is located more to the top than the top end portion of the support protrusion 38.

As shown in FIG. 3 and FIG. 4, an air purifying filter 60 is attached to the filter 40. The air purifying filter 60 is a filter capable of deactivating at least a part of germs, mold, and viruses or the like that are included in the air passing through the air purifying filter 60. The air purifying filter 60 in the present embodiment is attached to a bottom surface of a rear side portion in the second part 41*b* out of the filter main body 41. As shown in FIG. 3, the air purifying filter 60 is located above the second heat exchange device 22*b*. As shown in FIG. 4, the air purifying filter 60 extends from a right end portion of the filter 40 to the left end portion thereof. Air taken into the housing 21 from the intake port 20*a* after passing through the filter 40 passes through the air purifying filter 60 in the present embodiment.

In FIG. 3, air flow is represented by dashed arrows AF. When the blower 23 rotates about the rotation axis R, air is taken into the inside of the housing 21 from the plurality of intake ports 20*a* and the two insertion ports 50. In other words, a part of the air taken into the inside of the housing 21 by the blower 23 passes through the insertion port 50 in the present embodiment. The air taken into the inside of the housing 21 passes through the filter 40 and the heat exchange device 22 in such order, and is taken in by the blower 23. A part of the air that passes through the filter 40 flows to the heat exchange device 22 after passing through the air purifying filter 60. Air that is taken in by the blower 23 flows to an inclined front bottom direction, and is discharged to an outside of the housing 21 from the exhaust port 20*b*.

Figure 10:
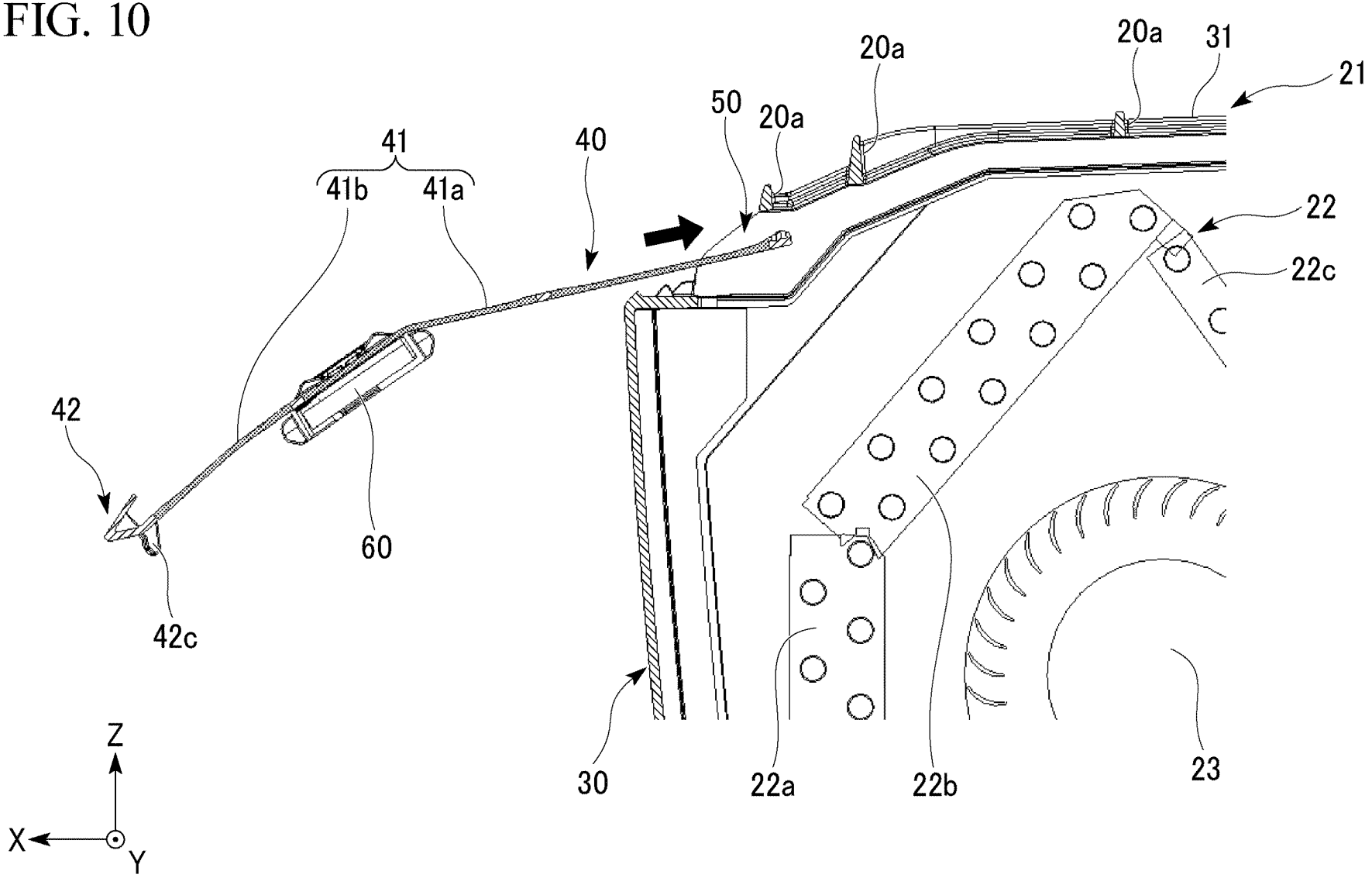
FIG. 10 A cross-sectional view that shows a part of procedures for attaching the filter to a housing in an embodiment.

FIG. 10 is a cross-sectional view that shows a part of procedures for attaching the filter 40 to the housing 21. As shown in FIG. 10, an operator attaching the filter 40 to the housing 21, installs the filter 40 to the housing 21 by inserting the filter 40 to an inside of the insertion port 50 from the front, in a state where the air purifying filter 60 is attached to the filter 40. At such time, the operator grasps the filter 40 by grasping the handle portion 42 with their fingers so as to bring the filter 40 closer to the insertion ports 50. As shown in FIG. 6, both end portions in the left-right direction Y of a part out of the filter 40 that is inserted into the inside of the housing 21 from the insertion port 50 are supported from below by the pair of guide portions 35*a* and 35*b*. As shown in FIG. 3, the operator inserts the filter 40 to an inside of the housing 21 via the insertion port 50 until a rear end portion of the filter main body 41 contacts the front surface of the opposing wall portion 35*f*. The operator mounts the handle portion 42 on top of the mounting portion 37 in a state where the filter main body 41 is in contact with the opposing wall portion 35*f*. When the handle portion 42 is mounted on top of the mounting portion 37, the first protrusion 42*c* of the handle portion 42 is inserted to an inside of the recess portion 37*a* formed in the mounting portion 37, and the second protrusion 36 formed on top of the mounting portion 37 is inserted to an inside of the hole 42*d* of the handle portion 42. The bottom end portion in the front end portion of the handle portion 42, in other words the supported end portion 43 is hooked to the support protrusion 38 from the rear. As such, the filter 40 is restrained from falling out to the front, and the filter 40 is in a state of being attached to the housing 21.

On the other hand, an operator removing the filter 40 from the housing 21 is able to remove the filter 40 from the housing 21 by grasping the handle portion 42 mounted on top of the mounting portion 37 from the front of the housing 21 and moving the filter 40, without needing to conduct work of removing a part of the housing 21 or the like. Specifically, the operator hooks their fingers HF to the cover wall portion 42*b* of the handle portion 42 as shown by dashed lines in FIG. 7. The operator pulls the cover wall portion 42*b* to the front using their fingers HF. At such time, since the supported end portion 43 hooks onto the support protrusion 38, the handle portion 42 rotates in a movement towards the front with the supported end portion 43 as a pivot, as seen in the left-right direction Y. As such, the base portion 42*a* and the first protrusion 42*c* move to the top, and along with the first protrusion 42*c* being removed from the inside of the recess portions 37*a*, the hole 42*d* formed in the base portion 42*a* moves to the top more than the second protrusion 36. As such, the first protrusion 42*c* and the recess portions 37*a* are disengaged, and the 36 and the hole 42*d* are disengaged. In a state of being disengaged, the operator slightly lifts up the handle portion 42, and moves the 43 to the top more than the support protrusion 38. By pulling the filter 40 to the front in such a state, the operator is able to pull out the filter 40 from the inside of the housing 21, and it is possible to easily remove the filter 40 from the housing 21.

Figure 11:
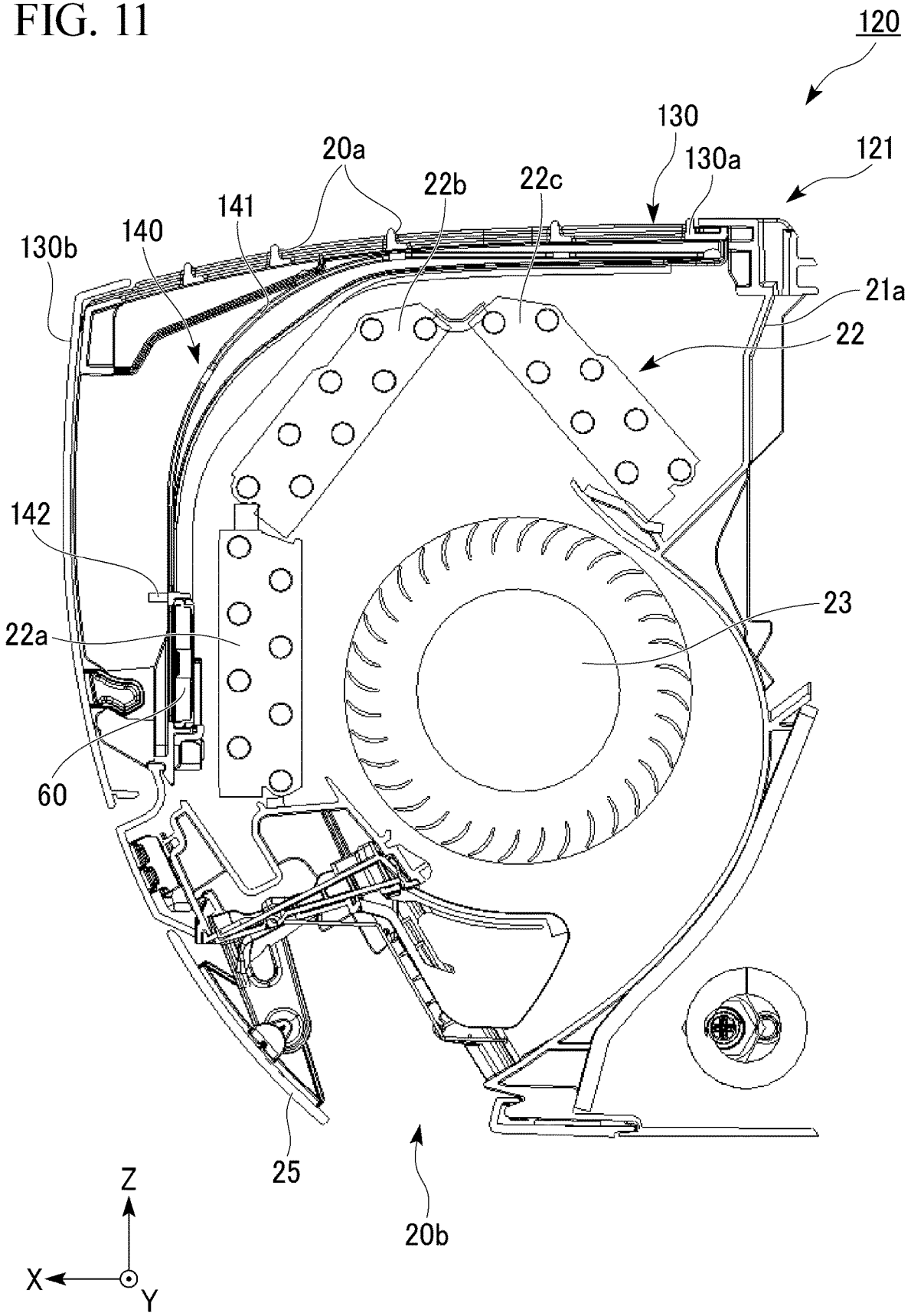
FIG. 11 A cross-sectional view that shows an example of a conventional indoor unit.
Figure 12:
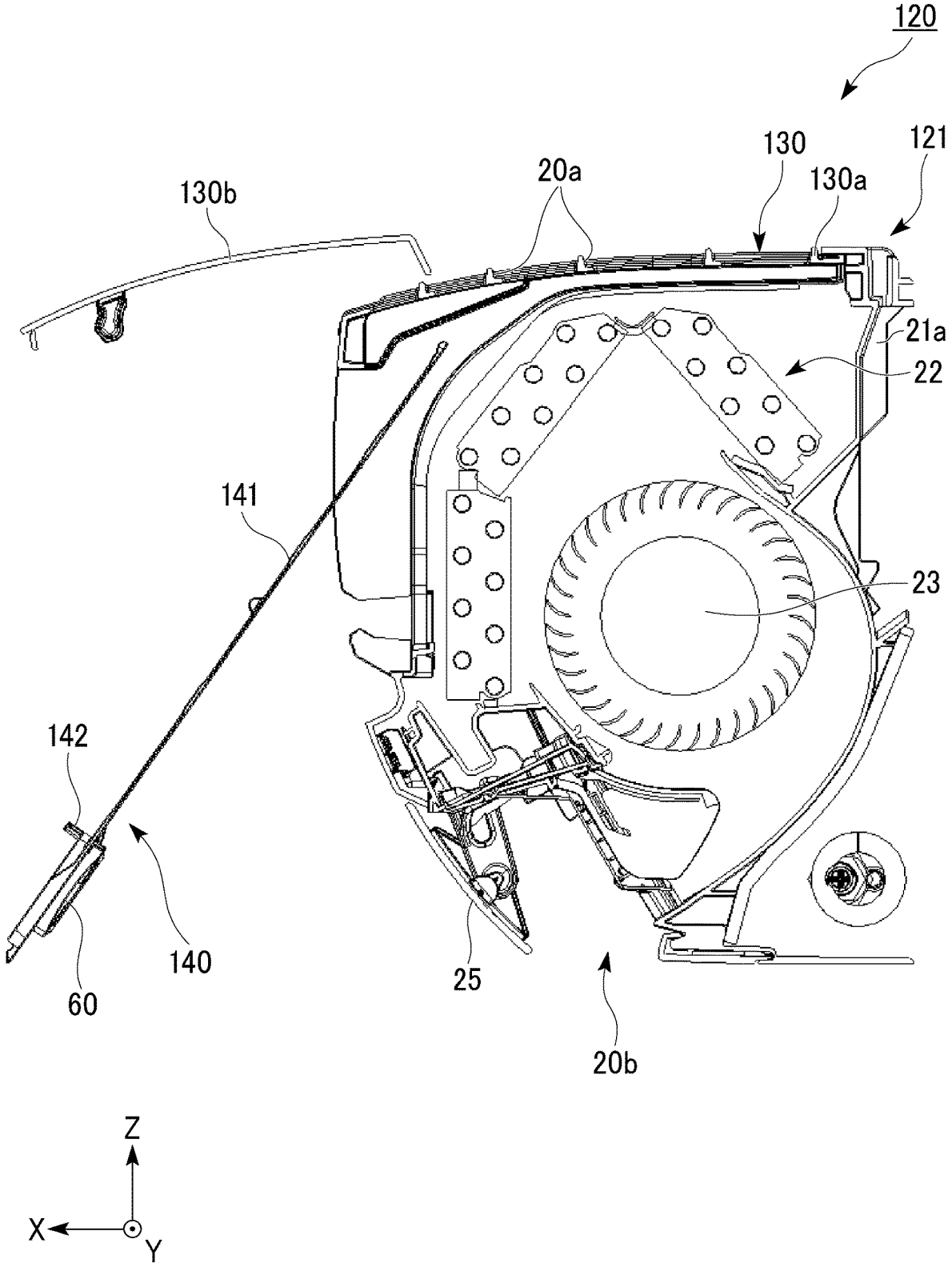
FIG. 12 A cross-sectional view that shows a portion of procedures for attaching the filter to the housing in the example of the conventional indoor unit.

FIG. 11 is a cross-sectional view that shows an indoor unit 120, which is an example of a conventional indoor unit. FIG. 12 is a cross-sectional view that shows a portion of procedures for attaching a filter 140 to a housing 121 in the example of the conventional indoor unit 120. In the explanation of a configuration of the conventional indoor unit 120, regarding configurations similar to those of the indoor unit 20 of the present embodiment, there are cases where similar configurations have the same reference signs in FIG. 11 and in FIG. 12 affixed to them and the like, with explanations thereof being omitted.

As shown in FIG. 11 and in FIG. 12, an outer shell member 130 of the housing 121 differs from the outer shell member 30 of the present embodiment in that the outer shell member 130 has a main body member 130*a* and a front surface panel 130*b* which is a separate body from the main body member 130*a*. The front surface panel 130*b* is a member that configures a part of the outer shell of the front side out of the outer shell of the housing 121. The main body member 130*a* is a part that configures parts other than the part configured by the front surface panel 130*b* out of the outer shell of the housing 121. Other than an aspect of the outer shell member 130 being configured by two members, the main body member 130*a* and the front surface panel 130*b*, the outer shell member 130 is similar to the outer shell member 30 of the present embodiment.

The front surface panel 130*b* configures more than half the outer shell of the front side out of outer shells of the housing 121. The front surface panel 130*b* is attached to be openable with respect to the main body member 130*a*. Specifically, the front surface panel 130*b* is attached to the main body member 130*a* so as to be able rotatable about an axis of rotation that extends in the left-right direction Y, with the top end portion of the front surface panel 130*b* as a pivot. When the front surface panel 130*b* is rotated, the front surface panel 130*b* is in a state of being open, as shown in FIG. 12. In a state where the front surface panel 130*b* is open, a gap in the vertical direction Z between a wall portion of a top side out of wall portions that configure the main body member 130*a* and the heat exchange device 22 is exposed to an outside of the housing 121. The plurality of intake ports 20*a* are formed on the wall portion of the top side out of the wall portions that configure the main body member 130*a*.

As shown in FIG. 11, the filter 140 in the indoor unit 120 covers the heat exchange device 22 from the front and from above. Specifically, a filter main body 141 of the filter 140 has a part that covers the first heat exchange device 22*a* and the second heat exchange device 22*b* from the front in an inside of the housing 121, and a part that covers the second heat exchange device 22*b* and the third heat exchange device 22*c* from above in the inside of the housing 121. The filter 140 is attached to the housing 121 by engaging a bottom end portion of a part located in the front of the heat exchange device 22 out of the filter main body 141 to the housing 121. The air purifying filter 60 is attached to a rear surface in the bottom end portion of a part located in the front of the heat exchange device 22 out of the filter main body 141.

A handle portion 142 of the filter 140 is provided on a part located in the front of the heat exchange device 22 out of the filter main body 141. The handle portion 142 is located further away to the top, more than the bottom end portion of a part located in the front of the heat exchange device 22 out of the filter main body 141. The handle portion 142 protrudes to the front. The handle portion 142 is covered by the front surface panel 130*b* from the front. As such, the handle portion 142 does not protrude to the outside of the housing 121 in a state where the front surface panel 130*b* is closed.

An operator attaching the filter 140 to the housing 121 in the indoor unit 120 first opens the front surface panel 130*b* as shown in FIG. 12. As previously mentioned, in this state, a gap in the vertical direction Z between the wall portion of the top side out of wall portions that configure the main body member 130*a* and the heat exchange device 22 is exposed to the outside of the housing 121. The operator attaches the filter 140 to the housing 121 by grasping, or the like, the handle portion 142 to insert the filter 140 into the exposed gap, causing the filter main body 141 to deform into a curve as shown in FIG. 11. Afterwards, the operator closes the front surface panel 130*b*. An operator removing the filter 140 from the housing 121 removes the filter 140 by grasping the handle portion 142 that is exposed to the outside of the housing 121 after opening the front surface panel 130*b*.

In the aforementioned conventional indoor unit 120, the front surface panel 130*b* needs to be opened and closed in order to attach and detach the filter 140 to and from the housing 121. For such reason, a problem of increased time and workload required for removing the filter 140 to conduct cleaning or the like or to conduct maintenance work on the filter 140 is a problem.

As opposed to the above, according to the present embodiment, the housing 21 has the insertion port 50 through which the filter 40 is inserted. The insertion port 50 is open to the front. The filter 40 is attached to the housing 21 so as to be detachable from the outside of the housing via the insertion port 50. Thus, it is possible to attach and detach the filters 40 with respect to the housing 21 as mentioned above, without needing to open a part of the housing 21. As such, the time and workload required for conducting maintenance work on the filter 40 is decreased, since there is no need to open and close the front surface panel 130*b* as in the conventional indoor unit 120.

Since there is no need to make the front surface panel 130*b* be openable as in the conventional indoor unit 120, it is possible to integrally form the main body member 130*a* and the front surface panel 130*b* in the conventional indoor unit 120. As such, it is possible to form the outer shell member 30 into an integral member as in the present embodiment. Therefore, compared to a case where the outer shell member 30 is made by assembling a plurality of members, it is possible to make the number of parts of the indoor unit 20 be less. As such, it is possible to reduce manufacturing costs of the indoor unit 20. By making the outer shell member 30 be an integrally formed member, dividing lines that would otherwise be formed between adjacent different members are not formed on an outer surface of the outer shell member 30. For such reason, it is possible to improve an outer design of the indoor unit 20.

According to the present embodiment, the intake port 20*a* that opens to the top is formed on the upper wall portion 31 in the housing 21. The insertion port 50 is formed on the top side part of the housing 21. As such, by inserting the filter 40 from the insertion port 50 into the inside of the housing 21, it is possible to easily dispose the filter 40 below the intake port 20*a* and above the heat exchange device 22. As such, even if a part of the filter 40 is not disposed in front of the heat exchange device 22 as with conventional indoor unit 120, it is possible to easily cover the entirety of the intake port 20*a* with the filter 40 from below, and passing all the air that is taken in from the intake port 20*a* through the filter 40 becomes easy. Therefore, there is no need to dispose a part of the filter 40 in front of the heat exchange device 22, making it possible to downsize an entire length of the filter 40. As such, it is possible to reduce manufacturing costs of the filter 40, and it is possible to reduce manufacturing costs of the indoor unit 20. As in the present embodiment, by attaching the air purifying filter 60 to the filter 40, disposing the air purifying filter 60 in a relatively close location to the intake port 20*a* becomes easy.

According to the present embodiment, the upper wall portion 31 in housing 21 has the upper wall inclined portion 31*b* be located in the bottom as the upper wall portion 31 heads towards the front. The insertion port 50 is formed on the upper wall inclined portion 31*b*, and is open to the front and to the top. As such, by having the insertion port 50 formed in the upper wall inclined portion 31*b*, compared to a case where the insertion port 50 are formed in a wall portion that extends along the vertical direction Z for example, it is possible to prevent the inside of the housing 21 from being seen from the outside of the housing 21 via the insertion port 50. Thus, it is possible to make it difficult for a user to see filter main body 41 that is inserted into the housing 21 from the insertion port 50 from the outside of the housing 21. As such, it is possible to further improve the outer design of the indoor unit 20.

According to the present embodiment, the filter 40 has the filter main body 41 that is disposed between the intake port 20*a* and the heat exchange device 22, and handle portion 42 that is disposed on the front end portion of the filter main body 41. The handle portion 42 is located in front of the insertion port 50. Thus, it is possible to suitably cover the insertion port 50 from the front by the handle portion 42. As such, it is possible to further prevent the inside of the housing 21 from being seen from the outside of the housing 21 via the insertion port 50. Therefore, it is possible to further improve the outer design of the indoor unit 20. It also becomes easier for an operator when removing the filter 40 from the housing 21 to grasp the handle portion 42. As such, it is possible to easily conduct detachment work of the filter 40 from the housing 21.

According to the present embodiment, the handle portion 42 as seen from the front, has at least a part of the cover wall portion 42*b* overlap with the insertion port 50. The cover wall portion 42*b* inclines to the rear as the cover wall portion 42*b* heads towards the top. Thus, making the cover wall portion 42*b* into a shape that forms along the upper wall inclined portion 31*b* is easier, and it is possible to suitably cover the insertion portion 50 which is formed to the upper wall inclined portion 31*b* from the front. As such, as shown in FIG. 8, it is easy to block a view LS of a user by the cover wall portion 42*b*, further suitably preventing the inside of the housing 21 to be seen from the outside via the insertion portion 50. Therefore, it is possible to further improve the outer design of the indoor unit 20. A dimension of the cover wall portion 42*b* in a direction which the cover wall portion 42*b* protrudes from the base portion 42*a* is large enough to suitably block the view LS of the user, and prevents the user from seeing the insertion port 50 from the outside. The dimension of the cover wall portion 42*b* is for example determined by a location indoors of the indoor unit 20 in the vertical direction Z, an average distance between the user and the indoor unit 20 from where the user is able to view the indoor unit 20, and an average height of the user or the like. It is preferable to have the dimension of the cover wall portion 42*b* be small, in a range of a dimension where the user is not able to view the insertion port 50 from the outside by suitably blocking the view LS of the user by the cover wall portion 42*b*. This is so that the smaller the dimension of the cover wall portion 42*b* becomes, the smaller areas of the insertion ports 50 to be blocked by the cover wall portion 42*b* may be, and it becomes difficult to hinder the air flow into the inside of the housing 21 from the insertion port 50.

By making the front surface of the cover wall portion 42*b* a decorative surface 42*e* of high design, it is possible to improve the design of a part that is visible to the user out of the handle portion 42. As such, it is possible to improve the outer design of the indoor unit 20. Specifically, it is possible to improve the outer design of the decorative surface 42*e* in the present invention by making the surface roughness of the decorative surface 42*e* be smaller than the surface roughness of surfaces other than the decorative surface 42*e* in the handle portion 42, and by making the decorative surface 42*e* a shiny surface.

Furthermore, so long as the decorative surface 42*e* has a higher design surface than a design of other parts in the decorative surface 42*e* of the handle portion 42, the design may be any improved surface design. The decorative surface 42*e* may be a painted surface, or may be a plated surface. The design of the decorative surface 42*e* in the handle portion 42 may be improved by having the handle portion 42 be made as a separate member from the filter main body 41, and the resin that forms the handle portion 42 may have a color thereof changed or the like.

According to the present embodiment, the housing 21 has a mounting portion 37 which is provided on the edge portions of the front side of the insertion port 50. The handle portion 42 has the base portion 42*a* mounted above the mounting portion 37, and the first protrusion 42*c* which protrudes from below the base portion 42*a* and is hooked onto the mounting portion 37 from the rear. As such, by having the first protrusion 42*c* hook onto the mounting portion 37, it is possible to suppress the movement of the filter 40 to the front with respect to the housing 21. Thus, it is possible to prevent the filter 40 from being removed unintentionally from the housing 21. In the present embodiment, the first protrusion 42*c* is inserted into the recess portion 37*a* formed in the mounting portion 37, and the first protrusion 42*c* is hooked to an inner edge of the recess portions 37*a*. As such, it is possible to firmly mount the first protrusion 42*c* with respect to the mounting portion 37.

According to the present embodiment, the housing 21 has the second protrusion 36 that protrudes to the top from the mounting portion 37. The hole 42*d* through which the second protrusion 36 is inserted is formed on a bottom surface of the 42*a* in the handle portion 42. As such, by hooking the second protrusion 36 to the inner surface of the hole 42*d*, it is possible to further suppress a movement of the filter 40 to the front with respect to the housing 21. Thus, it is possible to prevent the filter 40 from being removed unintentionally from the housing 21.

According to the present embodiment, the housing 21 has the support protrusion 38 to which the supported end portion 43 that is a bottom end portion on the front end portion of the handle portion 42 hooks onto from the rear. Thus, the movement of the filter 40 to the front with respect to the housing 21 is further suppressed. As such, it is possible to prevent the filter 40 from being removed unintentionally from the housing 21. As previously mentioned, when removing the filter 40 from the housing 21, as the operator pulls the handle portion 42 to the front using their fingers HF, with the supported end portion 43 as a pivot point, rotating the handle portion 42 around an axis of rotation that extends in the left-right direction Y becomes easy. As such, the base portion 42*a* and the first protrusion 42*c* are easily lifted to the top, and the first protrusion 42*c* and the mounting portion 37, and the second protrusion 36 and the hole 42*d* are easily disengaged. Therefore, it is possible to easily remove the filter 40 from the housing 21. When removing the filter 40 from the housing 21, since the indoor unit 20 is disposed in a relatively high location out of the indoor wall surface WS, it is easier for an operator to lift and extend their arms up, grasp the handle portion 42 using their fingers HF, and pull the filter 40 from the front. As such, even if the operator intends to simply pull the handle portion 42 to the front, pulling the handle portion 42 towards the front and towards the bottom becomes easier. Therefore, it becomes easy for the operator conducting removal work of the filters 40 from the housing 21 to rotate the handle portion 42 with the supported end portion 43 as the pivot point. As such, removing the filter 40 from the housing 21 becomes easy.

According to the current embodiment, a part of the air that is taken in by the 23 passes through the insertion port 50. In other words, the insertion port 50 is used as an intake port to inhale air into the housing 21. For such reason, it is possible to easily intake air into the housing 21. As previously mentioned, by making the dimension of the cover wall portion 42*b* the smallest possible within the range of a size that blocks the view LS of the user, it is possible to take air into the housing 21 from the insertion port 50 more easily.

According to the present embodiment, the outer shell member 30 is located in front of the heat exchange device 22, protrudes to the rear from each of the front wall portion 32 that configures a front side of the outer shell out of the outer shell of the housing 21 and both end portions of the front wall portion 32 in the left-right direction Y, has the side wall portions 33*a* and 33*b* which configure a portion of the outer shell of both sides in the left-right direction each out of the outer shell of the housing 21, and is formed integrally. As such, the outer design of the indoor unit 20 is suitably improved in cases where the indoor unit 20 is viewed from the front, and the indoor unit 20 is viewed from both directions of the left-right direction Y. As such, since there is no need to form a part of the front wall portion 32 as a separate member that opens as previously mentioned, it is possible to form the shell member 30 and the front wall portion 32 integrally with parts of the side wall portions 33*a* and 33*b*. In the present embodiment, the shell member 30 has the bottom wall portion 34 that configures an outer shell bottom side out of the outer shell of the housing 21. As such, it is possible to improve the outer design of the indoor unit 20 in a case where the indoor unit 20 is viewed from the below.

For example, as in the conventional indoor unit 120, in a case where the filter 140 has a part that covers the heat exchange device 22 from the front, there is a need attach a bottom end portion of the part that covers the heat exchange device 22 out of the filter 140 from the front to the housing 121, in order to prevent a flow of air taken into an inside of the housing 121 from the intake port 20*a* from flowing to the heat exchange device 22 by passing through a gap between the filter 140 and the housing 121. In such case, when providing the handle portion 142 in the bottom end portion of the part that covers the heat exchange device 22 out of the filter 140 from the front, the housing 121 is a hindrance, and it is difficult to grasp the handle portion 142. Although it is possible to think of changing the shape of the handle portion 142 to a design that is easier to grasp, in such a case, the handle portion 142 disposed on the inside of the housing 121 tends to easily become larger, and it is possible that the flow of air taken into the inside of the housing 121 is obstructed by the handle portion 142. For such reason, the handle portion 142 in the conventional indoor unit 120 is disposed in a location further away to the top from the bottom end portion of the part that covers the heat exchange device 22 out of the filter 140 from the front, as previously mentioned.

With respect to the above, according to the present embodiment, the filter 40 does not have a portion that covers the heat exchange device 22 from the front. As such, just attaching a front end portion of the filter 40 in front of the insertion port 50 with respect to the housing 21 is enough. In other words, it is possible to cover the intake port 20*a* from the bottom by the filter 40 without disposing the front end portion of the filter 40 on the inside of the housing 21. From the above, by providing the handle portion 42 having a shape that is easy to grasp on the front end portion of the filter main body 41, even if the handle portion 42 is attached to the housing 21, the flow of air after being taken into the inside of the housing 21 is not obstructed by the handle portion 42. Therefore, it is possible to have a shape of and location of the handle portion 42 be a suitable location and shape, so as to grasp the filter 40, while keeping the flow of air to the inside of the housing 21 suitable. As such, it is possible to easily conduct attachment and detachment work of the filter 40 with respect to the housing 21.

Although the above is an explanation of a present embodiment in the present disclosure, the present disclosure is not limited to the aforementioned explanation of present embodiment, and it is possible to adopt the configurations and methods below.

An insertion port that a housing of an indoor unit has may open to the front, and if it is possible to insert a filter from an outside of the housing of the indoor unit, the housing may be formed in any location. The insertion port may be formed in front of a center portion of the housing in the vertical direction Z. The insertion port may be formed in a bottom side portion of the housing. A single insertion port may be formed. Three or more insertion ports may be formed. A plurality of filters may be insertable with respect to the single insertion port.

The shape and the type of the filter that is disposed between an intake port and a heat exchange device are not particularly limited. For example, in a case where insertion port is formed on the center portion of the housing in the vertical direction Z or on the bottom side portion of the housing, the filter that is inserted to an inside of the housing from the insertion port may have a portion that covers the heat exchange device from the front. Only a part of a cover wall portion in a handle portion of the filter may overlap with the insertion portion, as seen from the front.

A shape of the housing of the indoor unit is not particularly limited. An upper wall portion of the housing need not include an upper wall inclined portion. So long as an outer shell member configures a part of an outer shell of the housing, the outer shell member may be any configuration. The outer shell member need not be formed as an integral shape. In other words, the outer shell member, may be formed from a plurality of members. The outer shell member may have an outer shell member main body, and decorative parts that are attached to the outer shell member main body.

The various configurations and methods described in the above description of the present disclosure may be appropriately combined, as long as the configurations and methods thereof do not mutually contradict one another.

The invention claimed is:

1. An indoor unit, which is the indoor unit of an air conditioner, and that is a wall-mounted type which is mounted on a wall, the indoor unit comprises:

a heat exchange device;

a blower;

a housing that has an intake port, and that houses the heat exchange device and the blower therein, and a filter that is disposed between the intake port and the heat exchange device, wherein the housing has:

an upper wall portion that is located at a top of the housing;

an insertion port through which the filter is inserted, and that is formed in the upper wall portion, and a mounting portion that is provided on an edge portion of the insertion port in a front side;

the intake port opens to the top and is formed on the upper wall portion, the insertion port opens to a front, and the filter has:

a filter main body that is disposed between the intake port and the heat exchange device;

a handle portion provided on a front end portion of the filter main body, and that is located in front of the insertion port, and the filter is attached to the housing so as to be detachable from an outside of the housing via the insertion port, and the handle portion has:

at least a part of a cover wall portion that overlaps with the insertion port as seen from the front;

a base portion mounted above the mounting portion, and a first protrusion which protrudes to a bottom from the base portion and is hooked onto the mounting portion from the rear, and a front surface of the cover wall portion is exposed to an outside of the housing.

2. The indoor unit according to claim 1, wherein:

the upper wall portion has an upper wall inclined portion that inclines downwards as the upper wall inclined portion heads towards a front, and the insertion port is formed in the upper wall inclined portion and opens to the front and to the top.

3. The indoor unit according to claim 1, wherein:

the cover wall portion inclines to the rear as the cover wall portion heads towards the top.

4. The indoor unit according to claim 1, wherein:

the housing has a second protrusion that protrudes to the top from the mounting portion, and on a bottom surface of the base portion, a hole through which the second protrusion is inserted through is formed.

5. The indoor unit according to claim 1, wherein:

the housing has a support protrusion, where a bottom end portion in a front end portion of the handle portion is hooked onto the support protrusion from the rear.

6. The indoor unit according to claim 1, wherein:

a part of air taken into an inside of the housing by the blower passes through the insertion port.

7. The indoor unit according to claim 1, wherein:

the housing has an outer shell member that configures a part of an outer shell of the housing, where the outer shell member includes:

a front wall portion that is located in front of the heat exchange device, and configures a front side outer shell out of outer shells of the housing, and a pair of side wall portions that protrude to the rear from both end portions of the front wall portion in the left-right direction, and that configure the outer shell of both sides out of the outer shells of the housing in the left-right direction, and the outer shell member is integrally molded.

8. An air conditioner comprising:

the indoor unit according to claim 1, and an outdoor unit.

* * * * *